US006782222B2

(12) United States Patent
Ito et al.

(10) Patent No.: US 6,782,222 B2
(45) Date of Patent: Aug. 24, 2004

(54) IMAGE FORMING APPARATUS AND PROCESS CARTRIDGE MOUNTABLE THEREIN IN WHICH A GAP EXISTS BETWEEN A MAIN ASSEMBLY ANTENNA OF THE APPARATUS AND A MEMORY ANTENNA OF THE PROCESS CARTRIDGE MOUNTED THEREON

(75) Inventors: Yoshihiro Ito, Mishima (JP); Kazushi Watanabe, Mishima (JP); Toshiyuki Karakama, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,536

(22) Filed: Aug. 23, 2001

(65) Prior Publication Data

US 2002/0025185 A1 Feb. 28, 2002

(30) Foreign Application Priority Data

Aug. 25, 2000 (JP) ..... 2000-255805

(51) Int. Cl.[7] ..... G03G 15/00; G03G 21/16

(52) U.S. Cl. ..... 399/111

(58) Field of Search ..... 399/111, 12, 13

(56) References Cited

U.S. PATENT DOCUMENTS

| | | | | |
|---|---|---|---|---|
| 5,937,239 A | | 8/1999 | Watanabe et al. | 399/111 |
| 5,966,566 A | | 10/1999 | Odagawa et al. | 399/109 |
| 6,097,908 A | | 8/2000 | Uchiyama et al. | 399/111 |
| 6,137,966 A | * | 10/2000 | Uehara et al. | 399/111 X |
| 6,160,526 A | | 12/2000 | Hirai et al. | 343/895 |
| 6,385,407 B1 | * | 5/2002 | Inose | 399/13 X |
| 6,404,995 B1 | * | 6/2002 | Kimizuka | 399/13 |

FOREIGN PATENT DOCUMENTS

| | | |
|---|---|---|
| JP | 07-146922 | 6/1995 |
| JP | 11-034558 | 2/1999 |
| JP | 2000-003115 | 1/2000 |
| JP | 2000-011121 | 1/2000 |
| JP | 2000-067193 | 3/2000 |
| JP | 2000-113154 | 4/2000 |
| JP | 2000-182017 | 6/2000 |

* cited by examiner

*Primary Examiner*—Fred L Braun
(74) *Attorney, Agent, or Firm*—Fitzpatrick, Cella, Harper & Scinto

(57) ABSTRACT

An electrophotographic image formation system forms an image on a recording material The system includes a process cartridge and an electrophotographic image forming apparatus to which the process cartridge is detachably mountable. The apparatus includes a main assembly and a main assembly antenna covered with a main assembly antenna outer casing member. The process cartridge includes an electrophotographic photosensitive member, a process device actable on the electrophotographic photosensitive member, a storing element storing information, a memory antenna for communication with the main assembly antenna, and a memory antenna outer casing member for covering the storing element and the memory antenna. Positioning is effected for a gap between the memory antenna and the main assembly antenna by contact between an outer surface of the memory antenna outer casing member and an outer surface of the main assembly antenna outer casing member of the main assembly antenna.

27 Claims, 29 Drawing Sheets

FIG. 22
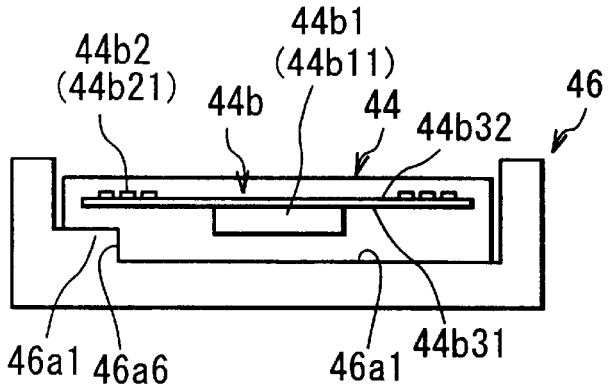
FIG. 23
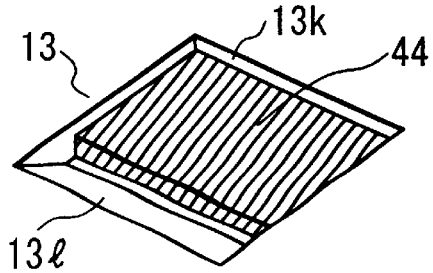
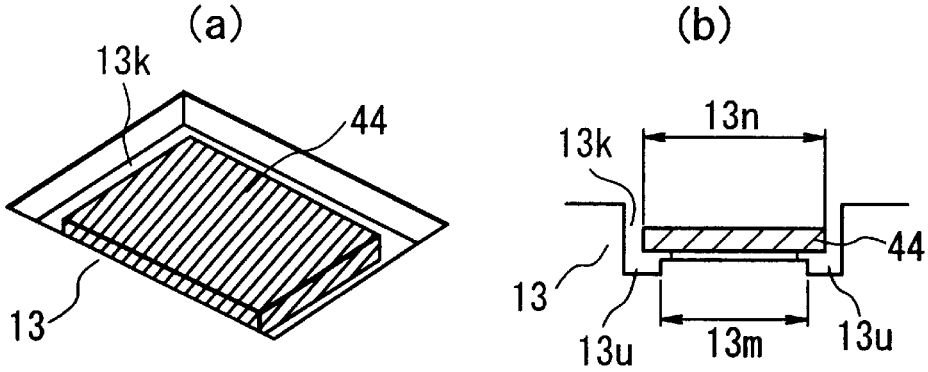
FIG. 24
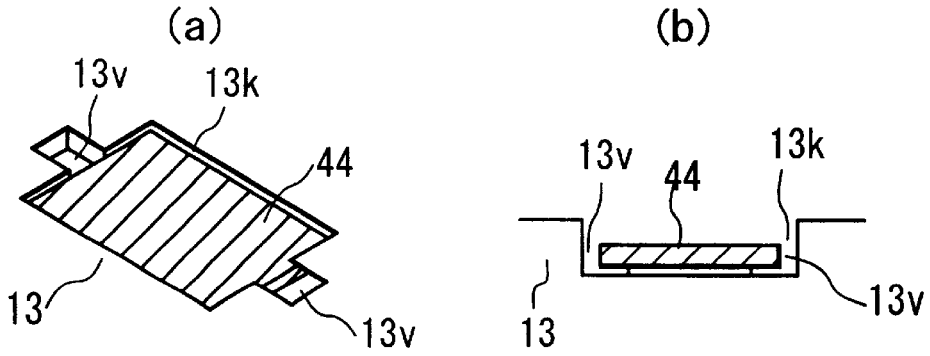
FIG. 25

IMAGE FORMING APPARATUS AND PROCESS CARTRIDGE MOUNTABLE THEREIN IN WHICH A GAP EXISTS BETWEEN A MAIN ASSEMBLY ANTENNA OF THE APPARATUS AND A MEMORY ANTENNA OF THE PROCESS CARTRIDGE MOUNTED THEREON

BACKGROUND OF THE INVENTION

Field of the Invention and Related Art

The present invention relates to an electrophotographic image formation system, a process cartridge and an electrophotographic image forming apparatus.

The electrophotographic image formation system forms an image on a recording material through an electrophotographic image formation type process. The electrophotographic image formation system may be used in electrophotographic copying machine, an electrophotographic printer (an LED printer, a laser beam printer or the like), an electrophotographic printer type facsimile machine, an electrophotographic printer type word processor or the like.

The process cartridge is a cartridge containing as a unit an electrophotographic photosensitive member and charge means, developing means or cleaning means (process means), the unit being detachably mountable to the main assembly of the electrophotographic image forming apparatus. The process cartridge is a cartridge containing as a unit an electrophotographic photosensitive member and at least one of charge means, developing means and cleaning means (process means), the unit being detachably mountable to the main assembly of the electrophotographic image forming apparatus. The process cartridge may be a cartridge containing as a unit an electrophotographic photosensitive member and at least developing means (process means), the unit being detachably mountable to the main assembly of the electrophotographic image forming apparatus.

The unit is an assembly which is demountably mountable as a whole to the main assembly of the electrophotographic image forming apparatus. Examples of the unit include a fixing unit for fixing the toner image transferred onto the recording material, thereon, a developing unit for developing an electrostatic latent image formed on the electrophotographic photosensitive member, and a feeding unit for accommodating the recording material.

The memory member is mounted to the process cartridge or unit and stores information relating to the process cartridge or the unit. The memory member may be a FERAM, or a non-volatile memory such as a ferromagnetic memory or the like.

In an electrophotographic image forming apparatus using the electrophotographic image forming process, use has been made of the process cartridge type system in which the process cartridge comprises as a unit the electrophotographic photosensitive member and process means actable on the electrophotographic photosensitive member, the unit being detachably mountable to the main assembly of the electrophotographic image forming apparatus. With the use of the process cartridge type system, the maintenance operation can be carried out in effect by the users without the necessity of relying on a serviceman, and therefore, the operability is improved. For this reason, it is widely used in the image forming apparatus.

For further easier maintenance operations for the main assembly of the image forming apparatus and for the process cartridge, the following method is used. A storing element (memory or storing means) is provided in the process cartridge, and the servicing information is stored in the storing element. When the process cartridge is mounted to the main assembly of the apparatus, a connector provided in the main assembly of the apparatus and a connector provided in the process cartridge are connected to each other. Through the connectors, the information in the storing element is taken by the main assembly of the apparatus. The main assembly of the apparatus discriminates the time of exchange of the process cartridge or the like, on the basis of the information. By doing so, the user is prompted for the maintenance operation of the process cartridge and/or the main assembly of the apparatus.

When the connectors are used for the electrical connection between the storing element provided in the process cartridge and the main assembly of the apparatus, the configuration of the process cartridge is complicated to permit the connector to be mounted. Therefore, the process cartridge tends to be bulky.

The present invention is intended to provide a further development of the above-described structure.

SUMMARY OF THE INVENTION

Accordingly, it is a principal object of the present invention to provide a process cartridge and an electrophotographic image forming system, wherein there is provided a storing element for storing information, and the information stored in the storing element can be transmitted to the main assembly of the apparatus through an antenna.

It is another object of the present invention to provide a process cartridge and an electrophotographic image forming system, wherein there is provided a storing element for storing information, and the information stored in the storing element can be transmitted to the main assembly of the apparatus when the storing element is out of contact with the main assembly of the apparatus.

It is a further object of the present invention to provide a process cartridge and electrophotographic image forming system, wherein there is provided a storing element for storing information, and the information stored in the storing element can be transmitted to the main assembly of the apparatus through wireless communication.

It is a further object of the present invention to provide a process cartridge, an electrophotographic image formation system and an electrophotographic image forming apparatus in which a gap between the memory antenna and the main assembly antenna can be maintained accurately.

According to an aspect of the present invention, there is provided an electrophotographic image formation system for forming an image on a recording material, the improvement residing in that when a process cartridge is mounted, to form an image on a recording material, to a main assembly of an electrophotographic image forming apparatus including a main assembly antenna covered with a main assembly antenna outer casing member, the process cartridge including an electrophotographic photosensitive member, process means actable on the electrophotographic photosensitive member, a storing element storing information, a memory antenna for communication with the main assembly antenna, and a memory antenna outer casing member for covering the storing element and the memory antenna, positioning is effected for a gap between the memory antenna and the main assembly antenna by contact between an outer surface of the outer casing member and an outer surface of an outer casing member of the main assembly antenna.

According to another aspect of the present invention, there is provided a process cartridge detachably mountable to a main assembly of an electrophotographic image forming apparatus which has a main assembly antenna covered with a main assembly antenna outer casing member, the process cartridge comprising an electrophotographic photosensitive member; process means actable on the electrophotographic photosensitive member; storing means for storing information; a memory antenna for communication with the main assembly antenna; and a memory antenna outer casing member covering the storing element and the memory antenna; wherein when the process cartridge is mounted to the main assembly of the apparatus, positioning is effected for a gap between the memory antenna and the main assembly antenna by contact between an outer surface of the outer casing member and an outer surface of an outer casing member of the main assembly antenna.

According to a further aspect of the present invention, there is provided an electrophotographic image forming apparatus for forming an image on a recording material, to which a process cartridge is detachably mountable, the electrophotographic image forming apparatus comprising:

(a) a main assembly antenna covered with a main assembly antenna outer casing member;

(b) a mounting portion for demountably mounting a process cartridge which comprises an electrophotographic photosensitive member, process means actable on the electrophotographic photosensitive member, a storing element for storing information, a memory antenna for communication with the main assembly antenna, and a memory antenna outer casing member covering the memory antenna;

the apparatus further comprising:

(c) feeding means for feeding the recording material, wherein when the process cartridge is mounted to the main assembly of the apparatus, positioning is effected for a gap between the memory antenna and the main assembly antenna by contact between an outer surface of the outer casing member and an outer surface of an outer casing member of the main assembly antenna.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 22 is a sectional view of the parts feeder and the memory unit shown in FIG. 21.

FIG. 23 is an illustration of a memory unit mounting portion having a tool inserting portion according to a first embodiment of the present invention.

FIG. 24 is an illustration of a memory unit mounting portion having a tool inserting portion according to a second embodiment of the present invention.

FIG. 25 is an illustration of a memory unit mounting portion having a tool inserting portion according to a third embodiment of the present invention.

DESCRIPTION OF THE PREFERRED EMBODIMENTS

The preferred embodiments of the present invention will be described in conjunction with the accompanying drawings.

In the specification, the lateral direction or widthwise direction is the direction in which the process cartridge B is mounted to the main assembly 14 of the electrophotographic image forming apparatus A, and is the same as the feeding direction of the recording material. The longitudinal direction of the process cartridge B is the direction crossing (substantially perpendicular) the direction in which the process cartridge is mounted to or demounted from the main assembly 14 of the image forming apparatus, and it is parallel with the surface of the recording material and crosses (substantially perpendicular) the feeding direction of the recording material. With respect to the process cartridge, the left and right directions are those as seen in the feeding direction of the recording material and from the top side. An upper surface of the cartridge B is a surface taking an upper position, and the lower surface is a surface taking a lower position, when the cartridge B is mounted to the main assembly 14 of the apparatus.

Figure 1:
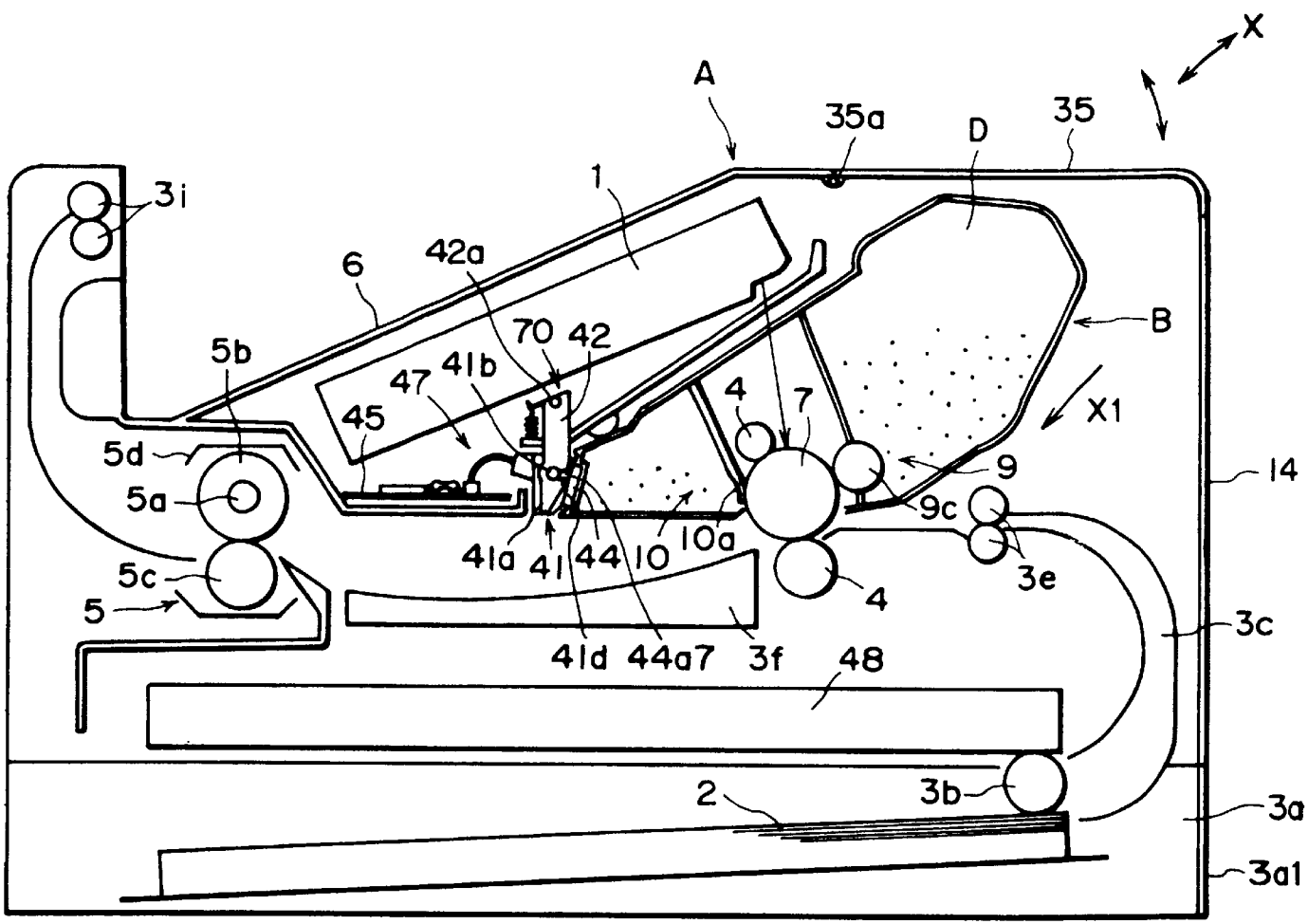
FIG. 1 is a sectional side elevation view of an electrophotographic image forming apparatus.
Figure 2:
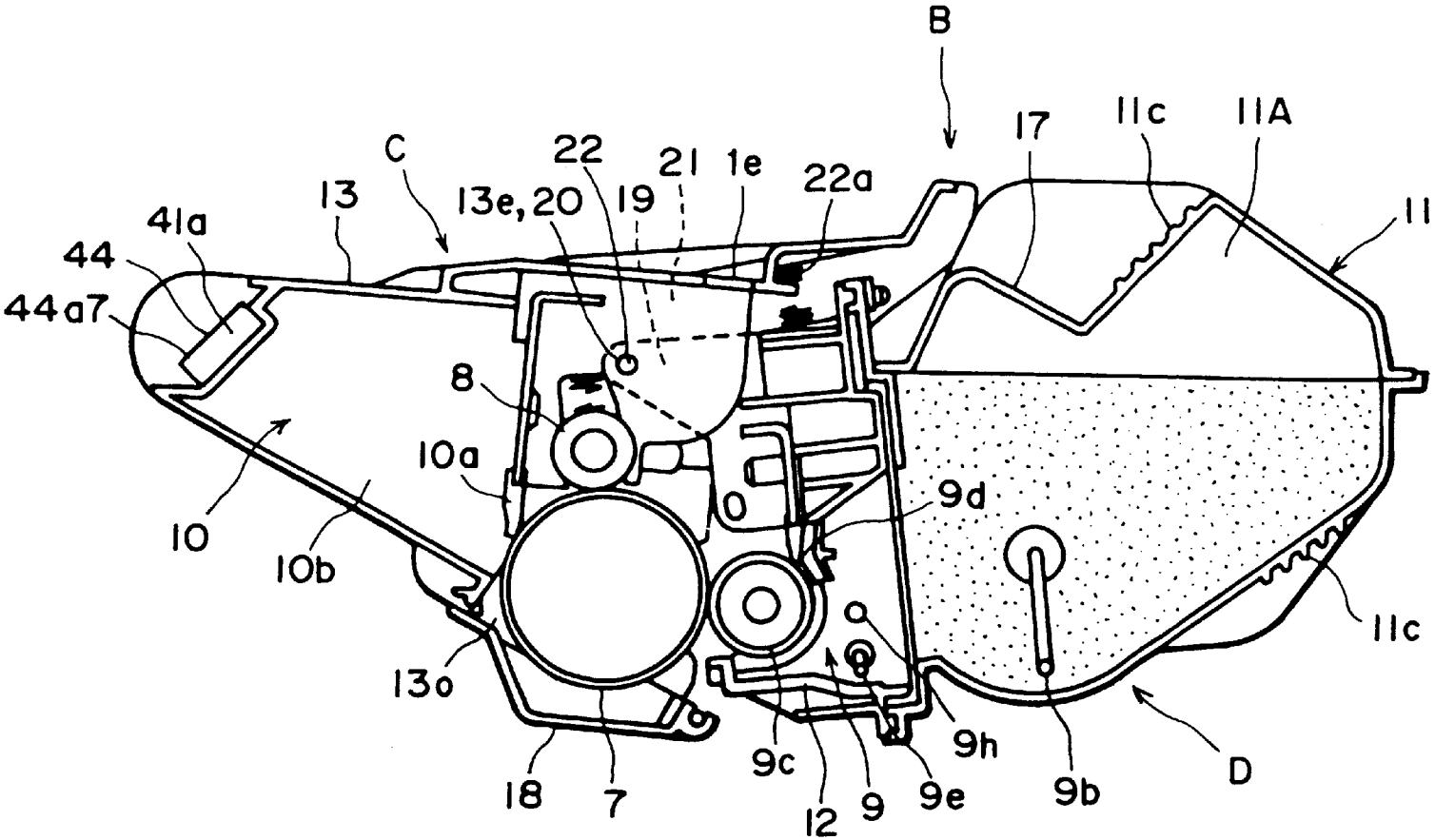
FIG. 2 is a sectional side elevation view of a process cartridge.
Figure 3:
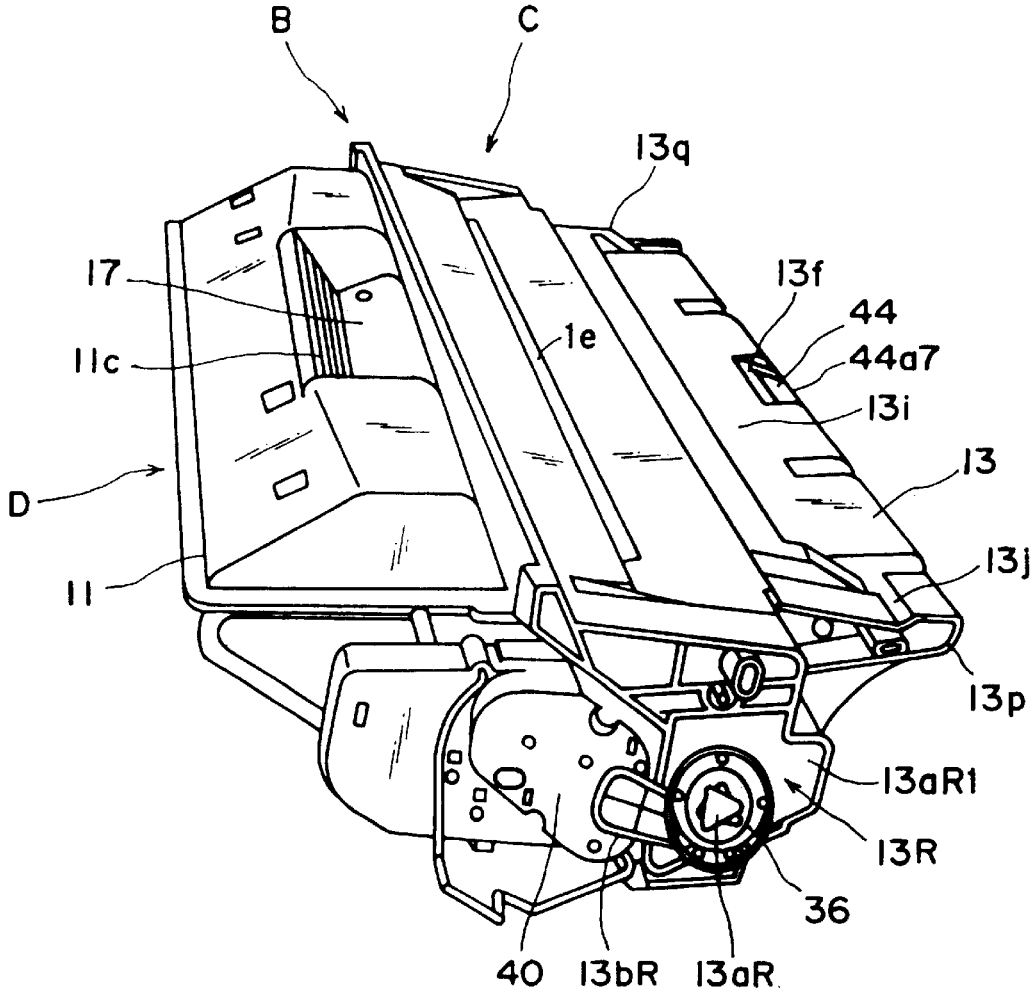
FIG. 3 is a schematic perspective view of a process cartridge.
Figure 4:
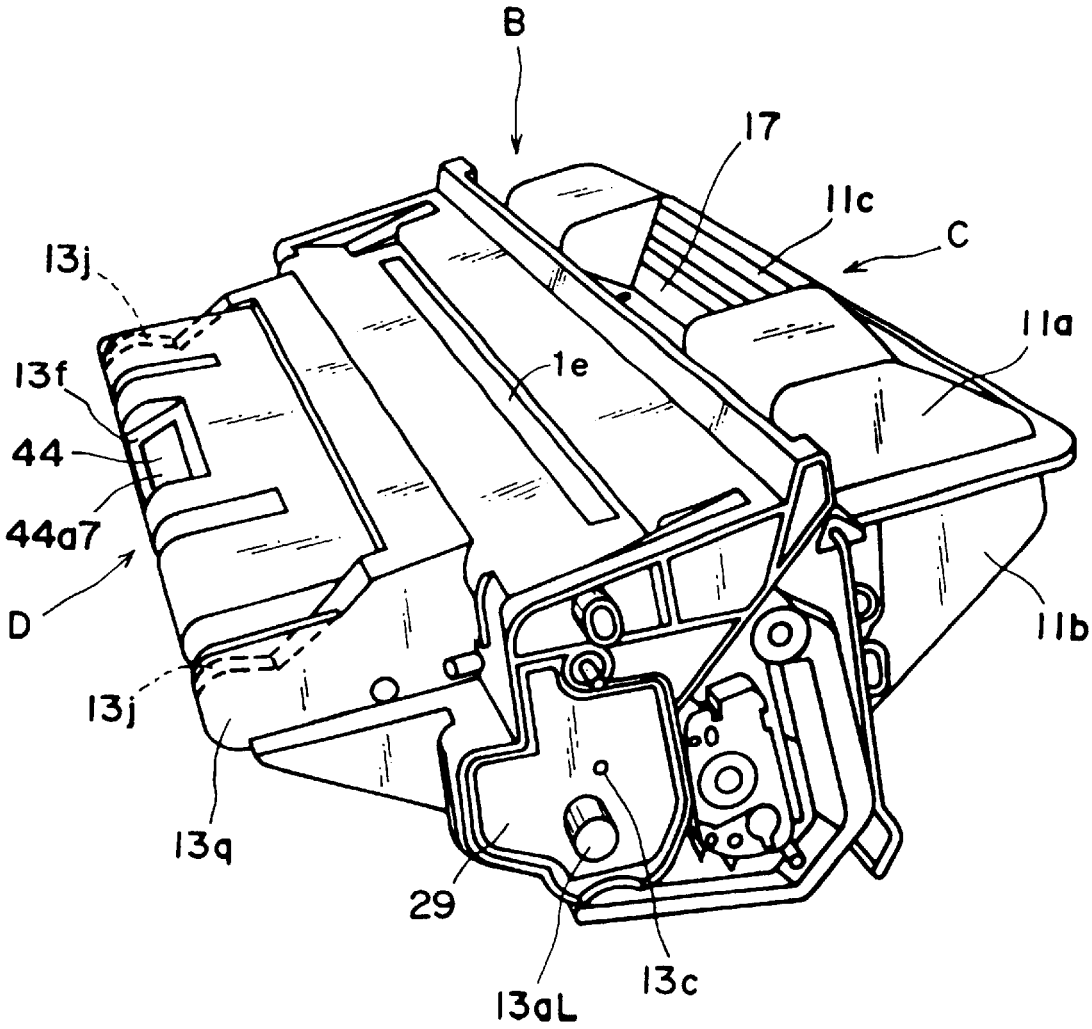
FIG. 4 is a schematic perspective view of a process cartridge.

FIG. 1 is an illustration of an electrophotographic image forming apparatus (laser beam printer) according to an embodiment of the present invention. FIGS. 2–4 are related with a cartridge according to an embodiment of the present invention. FIG. 2 is a sectional side elevation of a cartridge, FIG. 3 is a perspective view of the outer appearance of the cartridge, and FIG. 4 is a perspective view of the cartridge as seen from a top side thereof.

A description will be provided as to the general arrangements of the cartridge and the electrophotographic image forming apparatus, and then as to the structure of the cartridge.

(General Arrangement)

Referring to FIG. 1, the electrophotographic image forming apparatus (laser beam printer) A according to an embodiment of the present invention will be described. FIG. 2 is a sectional side elevation of the cartridge B.

As shown in FIG. 1, the image forming apparatus A operates to form an image on a recording material (recording paper, OHP sheet, textile or the like) 2 through an electrophotographic image forming process. A toner (developer) image is formed on an electrophotographic photosensitive member in the form of a drum (photosensitive drum). More particularly, the photosensitive drum is electrically charged by charging means. Then, the photosensitive drum is exposed to a laser beam modulated in accordance with image information by optical means so that electrostatic latent image is formed in accordance with the image information on the photosensitive drum. Subsequently, the electrostatic latent image is developed by developing means to form a toner image. Then, in synchronism with the formation of the toner image, the recording material 2 in the sheet feeding cassette 3*a* (feeding unit) is fed by a pick-up roller 3*b* along a feeding path 3*c* to a pair of registration rollers 3*e*. The toner image formed on the photosensitive drum 7 provided in the cartridge B is transferred onto the recording material 2 fed in timed relation with the image formation by the registration rollers, by application of the voltage to the transfer roller 4. Thereafter, the recording material 2 having received the toner image is fed to the fixing unit 5 along the feeding guide 3*f*. The fixing means 5 comprises a driving roller 5*c* (pressing roller) and a fixing roller 5*b* having a heater 5*a* therewithin. The toner image on the recording material 2 is fixed by application of heat and pressure. The recording material 2 is discharged to the discharging tray 6 by a pair of discharging rollers 3*i*. Here, the feeding cassette 3*a* is demountable to the main assembly 14 of the image forming apparatus. The feeding cassette 3*a* comprises a cassette frame 3*a*1 (unit frame), and accommodates the recording materials 2 in the cassette frame 3*a*1. The fixing unit 5 has a unit frame 5*d*. The unit frame 5*d* rotatably supports the driving roller 5*c* and the fixing roller 5*b*. In FIG. 1, designated by reference numeral 48 is a controlling unit. The controlling unit 48 functions to control the entirety of the electrophotographic image forming apparatus A.

In this embodiment, the developing means 9 is provided in the process cartridge B. However, the developing means 9 may be an independent developing unit which is detachably mountable to the main assembly 14 of the apparatus.

(Process Cartridge)

On the other hand, the cartridge B comprises the electrophotographic photosensitive member and at least one of process means. The process means includes charging means for electrically charging the electrophotographic photosensitive member, the developing means for developing the electrostatic latent image formed on the electrophotographic photosensitive member, cleaning means for cleaning the surface of the electrophotographic photosensitive member to remove the residual toner, or the like. As shown in FIGS. 2–4, in the cartridge B of this embodiment, the photosensitive drum 7 having a photosensitive layer is rotated, and the surface thereof is uniformly charged by application of a voltage to the charging roller 8. Then, a laser beam modulated in accordance with image information and supplied from an exposure device 1 (optical means) is projected onto the surface of the photosensitive drum 7 through an exposure opening 1*e*, by which electrostatic latent image is formed. Then, the electrostatic latent image is developed by developing means 9 using toner. The charging roller 8 contacts the photosensitive drum 7 to electrically charge it. The charging roller 8 is driven by the photosensitive drum 7. The developing means 9 supplies the toner to a developing zone of the photosensitive drum 7 to develop the electrostatic latent image formed on the photosensitive drum 7.

Here, the developing means 9 feeds the toner from the toner container 11A toward the developing roller 9*c* by rotation of the toner feeding member 9*b*. The developing roller 9*c* containing therein a fixed magnet is rotated, and a layer of toner triboelectrically charged by a developing blade 9*d* is formed on a surface of the developing roller 9*c*. The toner is supplied to the developing zone of the photosensitive drum 7. The toner image is formed (visualization) by transferring the toner in accordance with the electrostatic latent image onto the photosensitive drum 7. Here, the developing blade 9*d* functions to regulate the amount of the toner applied on the peripheral surface of the developing roller 9*c* and to apply the triboelectric charge to the toner particles. A rotatable toner stirring member 9*e* is provided adjacent to the developing roller 9*c* to circulate the toner in the developer chamber.

In the next station, there is a transfer roller 4 which is supplied with a voltage having a polarity opposite from that of the toner image. By doing so, the toner image formed on the photosensitive drum 7 is transferred on to the recording material 2 Thereafter, the photosensitive drum 7 is cleaned by the cleaning means 10 so that residual toner thereon is removed. The cleaning means 10 comprises an elastic cleaning blade 10*a* contacted to the photosensitive drum 7 and functions to scrape the residual toner off the photosensitive drum 7 and collect the scraped toner in a removed toner container 10*b*.

The cartridge B comprises a toner frame 11 having a toner container (toner accommodating portion) 11A for accommodating the toner, and a developing frame 12 supporting developing members such as a developing roller 9*c*, a developing blade 9*d* or the like, which frames are coupled with each other. To the coupled frames 11, 12, the cleaner frame 13 supporting the photosensitive drum 7, the cleaning means 10 such as the cleaning blade 10*a* and the charging roller 8, is coupled.

The cartridge B is detachably mountable to the main assembly 14 of the apparatus by the user.

The process cartridge B is provided with an exposure opening 1*e* for permitting exposure of the photosensitive drum 7 to the image information light and with an opening for facing the photosensitive drum 7 to the recording material 2. The exposure opening 1*e* is formed in the cleaner frame 13. The transfer opening 13*o* is formed between the developing frame 12 and the cleaner frame 13.

A description will be provided as to the structures of the housing (the cartridge frame).

The cartridge B in this embodiment is constituted by the toner frame 11 and the developing frame 12 which are coupled with each other. The cleaner frame 13 is rotatably coupled with the frame constituted by the frames 11, 12, by which the housing is constituted. The photosensitive drum 7, the charging roller 8, the developing means 9, the cleaning means 10 and the like, are contained in the housing to constitute the cartridge. The cartridge B is demountably mounted to the main assembly 14 of the apparatus by the operator moving it in the direction of arrow X1 (FIG. 1) to the cartridge mounting means.

(Structure of Housing of Cartridge)

The cartridge B of this embodiment, as described hereinbefore, is constituted by the toner frame 11, the developing frame 12 and the cleaner frame 13 which are coupled to constitute the housing. A description will be provided as to the structure thereof.

As shown in FIG. 2, the toner feeding member 9*b* is rotatably mounted to the toner frame 11. The developing roller 9*c* and the developing blade 9*d* are mounted to the developing frame 12. Furthermore, a toner stirring member 9*e* for circulating the toner in the developer chamber is rotatably mounted to the neighborhood of the developing roller 9*c*. To the developing frame 12, as shown in FIG. 2, an antenna rod 9*h* is mounted and extends substantially parallel with the developing roller 9*c*. The toner frame 11 and the developing frame 12 are welded with each other (ultrasonic welding in this embodiment) to constitute an integral developing unit D.

The developing unit D is provided with a drum shutter member 18 which functions to cover the photosensitive drum 7 when the cartridge B is dismounted from the main assembly 14 of the apparatus. The shutter member 18 is effective to prevent the photosensitive drum 7 from being exposed to light for a long term or to prevent it from being contacted by the foreign matter.

As shown in FIG. 2, the cleaner frame 13 supports the photosensitive drum 7, the charging roller 8 and the cleaning means 10 to constitute a cleaning unit C.

The developing unit D and the cleaning unit C are rotatably coupled with each other by a connecting member (pin) 22. In this manner, the cartridge B is constructed. As shown in FIG. 2, the developing frame 12 is provided at each of the opposite longitudinal ends (the axial direction of the developing roller 9*c*) with an arm portion 19. On the other hand, the cleaner frame 13 is provided at each of the opposite ends thereof with a recess 21 for receiving the arm portion 19. The arm portion 19 is inserted into the recess 21, and a connecting member 22 is press fitted into holes 13*e*, 20 formed in the cleaner frame 13 and in the arm portion 19. By this, the developing unit D and the cleaning unit C are coupled for rotation about the connecting member 22. At this time, a compression coil spring 22*a* mounted to a dowel (unshown) provided at a base portion of the arm portion 19 is abutted to an upper wall of the recess 21 of the cleaner frame 13. Thus, the developing frame 12 is urged downward by the elastic force of the spring 22*a*. By this, the developing roller 9*c* is assuredly urged to the photosensitive drum 7 through spacer rollers (unshown).

(Structure of Guide Means of Cartridge)

Figure 5:
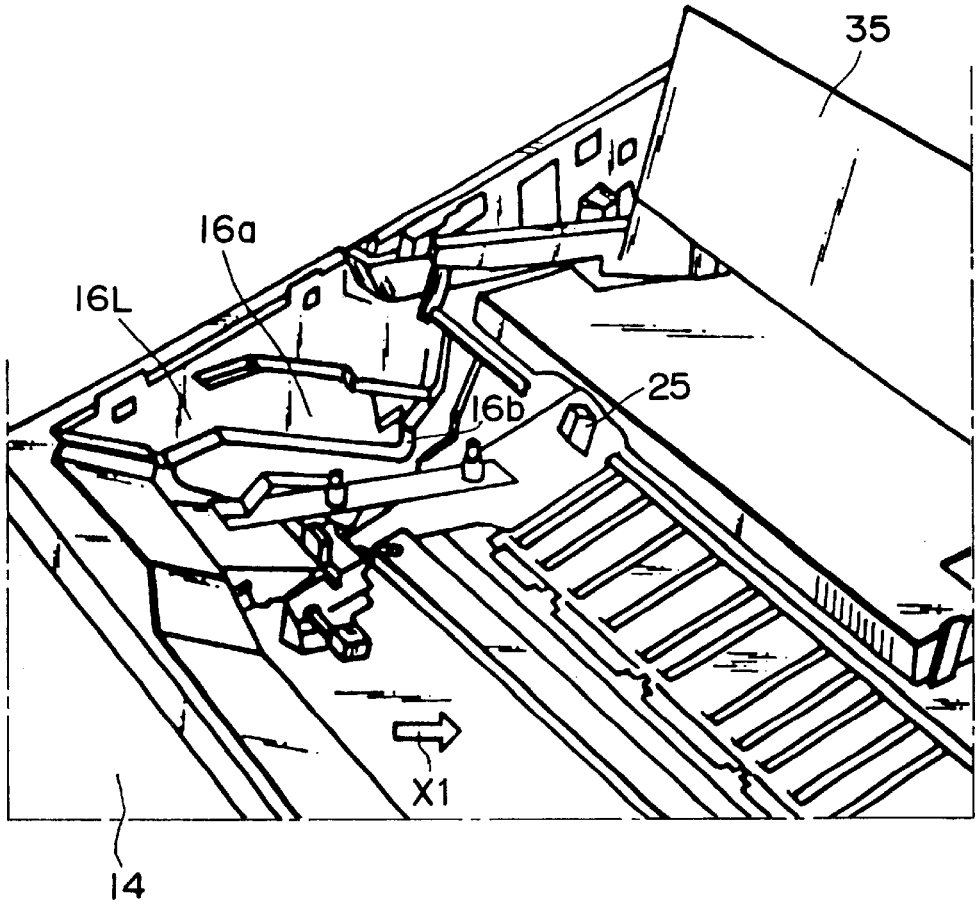
FIG. 5 is a perspective view of a process cartridge mounting portion provided in a main assembly of the apparatus.
Figure 6:
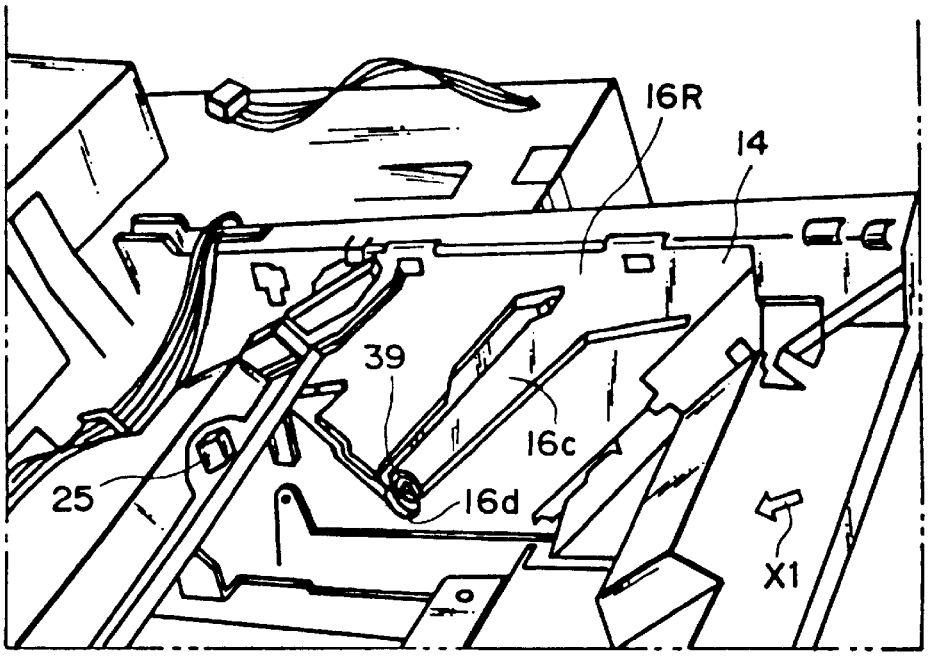
FIG. 6 is a perspective view of a process cartridge mounting portion provided in a main assembly of the apparatus.

A description will be provided as to the guide means for guiding the process cartridge B when it is mounted to the main assembly 14 of the apparatus. FIGS. 5 and 6 show the guide means. FIG. 5 is a perspective view as seen from the left side (from the developing unit D side) in the direction (arrow X1) in which the process cartridge B is mounted to the main assembly A. FIG. 6 is a perspective view of the righthand side.

As shown in FIGS. 3 and 4, each of the opposite ends of the cleaner frame 13 is provided with guide means to be guided when the cartridge B is mounted to the main assembly 14 of the apparatus. The guide means comprises cylindrical guides 13*a*R, 13*a*L functioning as a guide member for determining the position of the cartridge relative to the main assembly of the apparatus, and an anti-rotation guide 13*b*R functioning as a stopper for preventing rotation of the process cartridge when it is mounted to the main assembly of the apparatus.

As shown in FIG. 3, the guide 13*a*R is in the form of a hollow cylindrical member. The guide 13*b*R is integrally formed with the guide 13*a*R, and is extended radially outwardly along a line from the circumference of the guide 13*a*R. The guide 13*a*R is provided with an integral flange 13*a*R1. The right-hand side guide member 13R having the guide 13*a*R, guide 13*b*R and the flange 13*a*R1 is fixed to the cleaner frame 13 by screws (unshown) threaded through the screw holes of the flange 13*a*R1. The guide 13*b*R of the right-hand side guide member 13R fixed to the cleaner frame 13 is disposed adjacent the side surface of the developing frame 12 such that it is extended to extend over the end of the development holder 40 fixed to the developing frame 12.

As shown in FIG. 4, to the side surface of the cleaner frame 13, a flange 29 in the form of a flat plate is engaged with the positioning pin 13*c* for anti-rotation, and is fixed to the cleaner frame 13 by screws (unshown). The flange 29 is provided with a cylindrical guide 13*a*L extended outwardly in the direction of the axis of the photosensitive drum 7.

A description will be provided as to a regulating abutment 13*j* provided on the upper surface 13*i* of the cleaning unit C. Here, the upper surface is the surface which takes an upper position when the cartridge B is mounted to the main assembly 14 of the apparatus.

In this embodiment, as shown in FIGS. 3 and 4, the regulating abutment or contact portion 13*j* is provided a right-hand end 13*p* and left-hand end 13*q* in the direction perpendicular to the mounting direction of the cartridge, on the upper surface 13*i* of the cleaning unit C. The contact portion 13*j* functions to regulate the position of the cartridge B when the cartridge B is mounted to the main assembly 14 of the apparatus. Therefore, when the cartridge B is mounted to the main assembly 14 of the apparatus, the regulating abutment 13*j* is contacted to the fixing member 25 (FIGS. 5 and 6) provided in the main assembly 14 of the apparatus. By this, the angular position of the cartridge B about the guides 13*a*R, 13*a*L, is determined.

A description will be provided as to the guide means (mounting means) provided in the main assembly 14 of the apparatus. When the opening and closing member 35 of the main assembly 14 of the apparatus is rotated in the couter-clockwise direction in FIG. 1 about the fulcrum 35*a*, the upper portion of the main assembly 14 of the apparatus is opened. By this, the mounting portion of the cartridge B can be seen (FIGS. 5, 6). Left and right inner walls of the main assembly 14 of the apparatus are provided with guide members 16L, 16R, respectively.

The guide members 16R, 16L are provided with guide portions 16*a*, 16*c* which are inclined downward as seen in a direction of arrow X1 (inserting direction of the cartridge B) and semicircular positioning grooves 16*b*, 16*d* which continue from the guide portions 16*a*, 16*c* and into which the guides 13*a*R, 13*a*L of the cartridge B are snugly fitted. The grooves 16*b*, 16*d* have a cylindrical circumference walls. The centers of the grooves 16*b*, 16*d* are concentric with the center of the guides 13*a*R, 13*a*L of the cartridge B when the cartridge B is mounted to the main assembly 14 of the apparatus. Therefore, they are concentric with the photosensitive drum 7.

The guide portions 16*a*, 16*c* of the main assembly 14 are so large that guides 13*a*R, 13*a*L are loosely fitted therein in the mounting-and-demounting direction of the cartridge B. The guide 13*b*R is therefore loosely fitted, since it has a width smaller than the diameter of the guide 13*a*R. However, guides 13*a*R, 13*a*L and the guide 13*b*R are limited in the rotational direction by the guide portion 16*a*. By this, the cartridge B is mounted to the main assembly 14 of the apparatus with an orientation within a limited range. When the cartridge B has been mounted to the main assembly 14 of the apparatus, the guides 13*a*R, 13*a*L of the cartridge B are engaged with the grooves 16*b*, 16*d*. And, the contact portion 13*j* is contacted to the fixing member 25 of the main assembly 14 of the apparatus.

The weight distribution of the cartridge B is such that when the center line connecting the centers of the guides 13*a*R, 13*a*L, the developing unit D side is heavier than the cleaning unit C side, and therefore, the resulting static moment is in the direction of lowering the developing unit D side.

When the user mounts the cartridge B into the main assembly 14 of the apparatus, the user's hand grips the toner frame 11 shown in FIG. 2 at the recess 17 and the lower side rib 11*c*. Then, the guides 13*a*R, 13*a*L are inserted along the guide portions 16*a*, 16*c*, and the guide 13*b*R is inserted into the guide portion 16*c* of the main assembly 14 of the apparatus. Finally, a drive transmitting member 36 (FIG. 3) provided integrally with a drum gear (unshown) fixed to the end of the photosensitive drum 7 is engaged with a drive transmitting member 39 (FIG. 6) provided in the groove 16*b*, so that the position of the photosensitive drum 7 relative to the main assembly 14 of the apparatus is determined.

The steps of dismounting the cartridge B from the main assembly 14 of the apparatus are opposite from the steps described in the foregoing. More particularly, the user opens the opening and closing member 35, and grips the grip portion of the cartridge B at the lower side rib 11*c* and raises the cartridge B. Then, the user pulls the cartridge B along the guide portions 16*a*, 16*b*.

The photosensitive drum 7 of the cartridge B is provided with a spur gear (unshown) at the opposite end of the drive transmitting member 36. The spur gear is brought into meshing engagement with a gear (unshown) which is coaxial with the transfer roller 4 provided in the main assembly 14 of the apparatus when the cartridge B is mounted to the main assembly 14 of the apparatus, so that a driving force for rotating the transfer roller 4 is transmitted from the cartridge B to the transfer roller 4.

(Wireless Communication System)

A description will be provided as to an information communication system of a wireless type for communication between the main assembly 14 of the apparatus and the cartridge B.

In this embodiment, the wireless communication system is such that cartridge B is provided with a magnetic core which functions as a communication antenna. The main assembly 14 of the apparatus is provided with an inductor which functions as a communication antenna. When the cartridge B is mounted to the main assembly 14 of the apparatus, the information communication between the main assembly 14 and the cartridge B is wirelessly carried out through electromagnetic induction of the inductor type through the magnetic core. In other words, in this embodiment, the information communication between the main assembly 14 of the apparatus and the cartridge B is effected between antennas using the electromagnetic energy. Thus, the information communication is carried out wirelessly. By doing so, the possible size-increase of the cartridge B is avoided, and communication trouble due to improper mechanical contact between connectors for information transmission provided in the main assembly 14 of the apparatus and in the cartridge B.

Referring to FIGS. 1, 3, 4, 7, and 8, a description will be provided as to the wireless communication system according to an embodiment of the present invention.

As shown in FIGS. 1, 3, 4, and 7, the cartridge 2 is provided with a memory unit 44 (memory member). The main assembly 14 of the apparatus is provided with a communicating unit 47 (main assembly communicating means). The communicating unit 47 comprises a communication controlling unit 45 fixed to the main assembly 14 of the apparatus, an equalizer mechanism 70 provided in the main assembly 14 of the apparatus, and an antenna unit 41 (main assembly antenna) connected to the communication controlling unit 45. Between the memory unit 44 provided in the cartridge B and the communicating unit 47 provided in the main assembly 14 of the apparatus, the communication is electrically carried out without contact. That is, the wireless information communication is provided. As shown in FIG. 8, when the cartridge B is mounted to the main assembly 14 of the apparatus, the communication antenna 44*b*2 (memory antenna) provided in the unit 44 and the communication antenna 41*c* (main assembly antenna) provided in the antenna unit 41, face each other with correct positioning accomplished by the equalizer mechanism 70. More particularly, by the abutment of the frame member 44*a*

(outer casing member) to the antenna cover 41*a*, the gap is regulated between the communication antenna 44*b*2 (memory antenna) and the communication antenna 41*c* (main assembly antenna). Then, the electric energy is supplied to the storing element 44*b*1 of the unit 44, so that wireless communication between the unit 45 and the storing element 44*b*1 is enabled. Thus, information can be read from or written in the storing element 44*b*1.

A description will be provided as to the wireless communication system, more particularly, the memory unit, the arrangement and structure of the memory unit, an abutment structure between the memory unit and the antenna unit and the structure of the wireless communicating mechanism, in the order named.

I. Memory Unit (Memory Unit Structure 1)

(First Embodiment)

Figure 9:
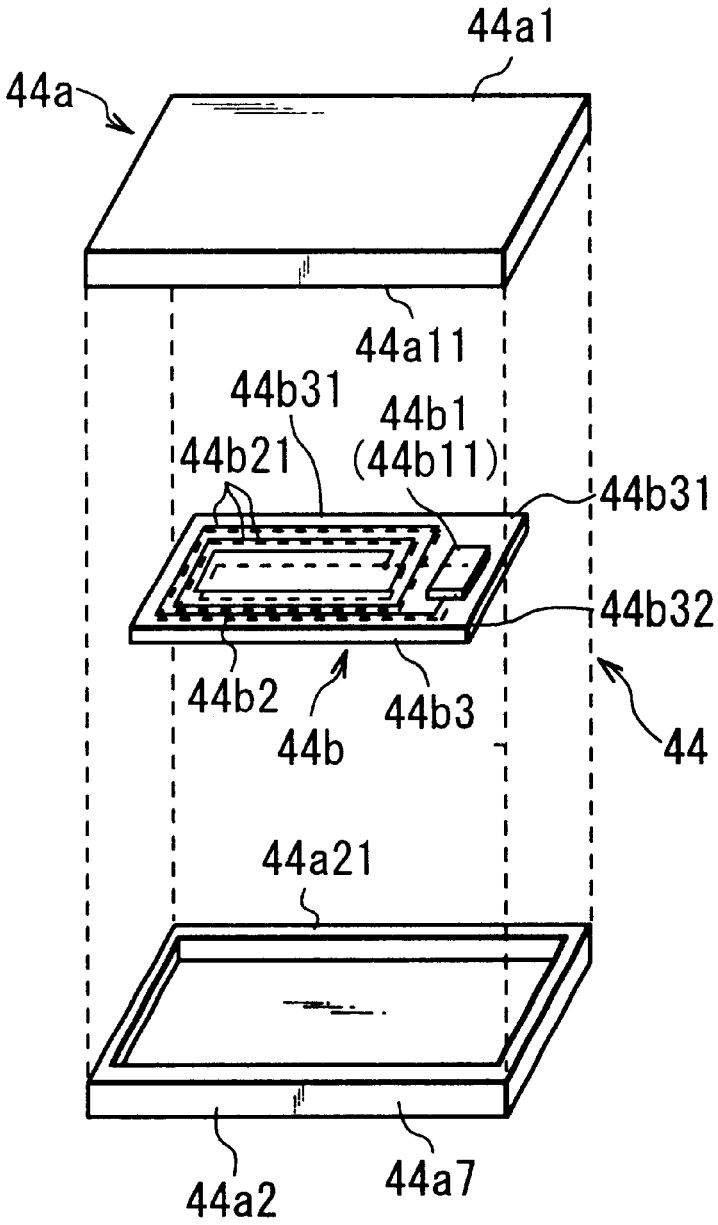
FIG. 9 is an exploded perspective view of a memory unit wherein the storing element is disposed outside a communication antenna.

Referring to FIG. 9, a structure of the memory unit will be described. FIG. 9 is an exploded perspective view of a memory unit.

The unit 44 is in the form of a tag comprising a substrate unit 44*b* and a frame member 44*a* (outer casing member) covering the substrate unit 44*b*. The substrate unit 44*b* includes the storing element 44*b*1 for storing information, an antenna 44*b*2 (magnetic core as a memory antenna) for communication and a substrate 44*b*3 for carrying the storing element 44*b*1 and the communication antenna 44*b*2, as a unit. The storing element 44*b*1 is provided on a rectangular substrate 44*b*3 made of epoxy resin material. More particularly, the storing element 44*b*1 is provided on a back side 44*b*31 of the substrate 44*b*3 (the side opposite from the side which faces the antenna unit 41 provided in the main assembly 14 of the apparatus), and is disposed outside a conduction pattern 44*b*21 constituting the antenna 44*b*2. The storing element 44*b*1 comprises a FERAM. The storing element 44*b*1 is integral with a sending circuit 44*b*11 (sending member) shown in FIG. 15. The sending circuit 44*b*11 functions to send the information stored in the storing element 44*b*1 to the antenna 44*b*2. The sending circuit 44*b*11 will be described in detail hereinafter. The antenna 44*b*2 has an electroconductive pattern 44*b*21 in the form of a volute extended on the substrate 44*b*3 along the sides of the rectangular shape of the substrate 44*b*3. The pattern 44*b*21 is formed continuously on the back side 44*b*31 and on the surface 44*b*32 of the substrate 44*b*3 by printing. The pattern 44*b*21 is connected with a storing element 44*b*1 FERAM, for example).

In summary, the back side 44*b*31 of the substrate 44*b*3 is provided with the storing element 44*b*1, the sending circuit 44*b*11 and the electroconductive pattern 44*b*21 (memory antenna). The memory antenna, at its one and the other ends, is electrically connected to the sending circuit 44*b*11.

The substrate unit 44*b* having such a structure is disposed in the frame member 44*a* functioning as an outer casing member. The frame member 44*a* comprises an upper outer casing portion (upper frame 44*a*1) made of polystyrene resin material and a lower outer casing portion (lower frame 44*a*2). The upper frame 44*a*1 and the lower frame 44*a*2 are provided with projected portions 44*a*11, 44*a*21 at the circumference thereof. The projected portions 44*a*11, 44*a*21 of the upper frame 44*a*1 and the lower frame 44*a*2 are contacted to each other to constitute a frame member 44*a*. The projected portions 44*a*11, 44*a*21 of the upper frame 44*a*1 and the lower frame 44*a*2 are fixed by an adhesive material, welding, ultrasonic welding or the like after the substrate unit 44*b* is inserted. The material of the frame member 44*a* has a physical strength against the abutment to the unit 41 constituting the unit 47 of the main assembly 14, and has an electrostatic shield property. More particularly, the frame member 44*a* is made of a material having a dielectric constant of 2–5. The dielectric constant is determined by the ASTM test method D150. The material of the outer casing member frame member 44*a* may be the above-described polystyrene resin material, acrylic nytril butadiene resin material, polycarbonate resin material or the like.

In such a unit 44, the substrate unit 44*b* provided with substrate 44*b*3 having the storing element 44*b*1, the communication antenna 44*b*2 and the sending circuit 44*b*1, is covered with the frame member 44*a*. Therefore, the storing element 44*b*1 can be protected from an external load or from an electrical influence. Since the substrate unit 44*b* is contained in the frame member 44*a* to constitute a tag-like member, the carrying space can be efficiently determined in the main assembly 14 or in the cartridge B. In addition, since it is constituted by three members, namely, the substrate unit 44*b*, the upper frame 44*a*1 and the lower frame 44*a*2, the assembling operation is easy.

(Second Embodiment)

Figure 10:
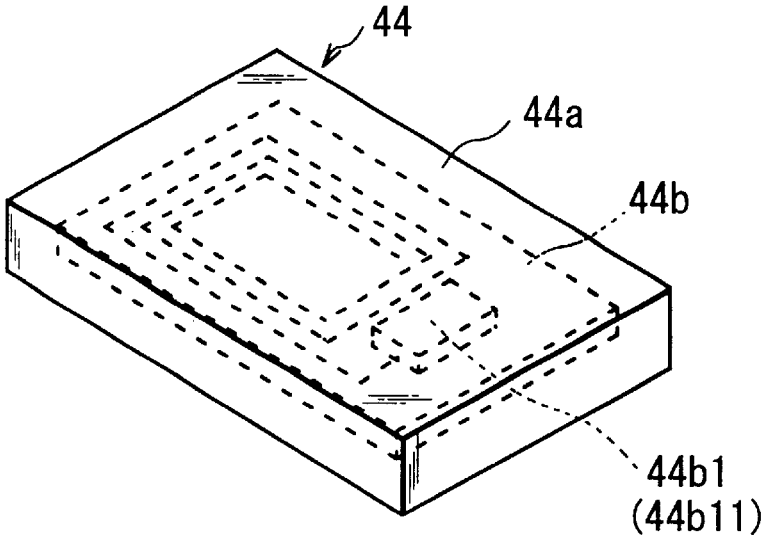
FIG. 10 is a perspective view after assembling of the memory unit shown in FIG. 9.

FIG. 10 is a perspective view of a memory unit according to a second embodiment of the present invention.

In this embodiment, the frame member 44*a* covering the unit 44*b* is produced through an injection molding of a resin material. More particularly, the memory unit 44 of this embodiment is produced by inserting a substrate unit 44*b* into a resin material mold and ejecting the resin material (insertion molding) with the inserted state.

In this case, the same advantageous effects as with the first embodiment can be provided.

(Third Embodiment)

Figure 11:
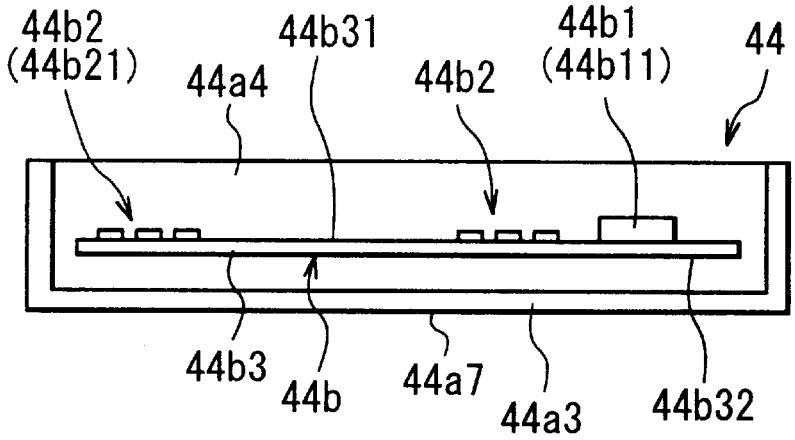
FIG. 11 is a sectional view of a memory unit shown in FIG. 9 according to another embodiment.

FIG. 11 is a sectional view of a memory unit according to a third embodiment of the present invention.

In this embodiment, the frame member outer casing member 44*a* covering the unit 44*b* is constituted by the resin material case 44*a*3 and a resin material or an elastomer 44*a*4 injected into the resin material case 44*a*3. In this embodiment, the unit 44 is produced by inserting the unit 44*b* into a resin material case 44*a*3 and injecting the elastomer 44*a*4 into the case 44*a*3 to fill it up.

With this structure, the unit 44 is advantageous similarly to the memory unit 44 in the first embodiment.

In the foregoing embodiments, the unit 44*b* is constituted by the storing element 44*b*1 provided with the sending circuit 44*b*11 and the communication antenna 44*b*2 which are disposed on the substrate 44*b*3 of the epoxy resin material. However, it is an alternative that they are disposed on different substrates, and they are connected by metal contacts or leads or the like.

In the memory unit 44 in the foregoing embodiments, there are provided a beveled portion 44*a*5 and a stepped portion 44*a*6 although they are not shown in the figures.

The information stored in the storing element 44*b*1 are related with the process cartridge unit. For example, it is an integrated number of rotations of the photosensitive drum, the integrated charging time of the charging means, the remaining amount of the developer, or the like.

(Memory Unit Structure 2)

(First Embodiment)

Figure 12:
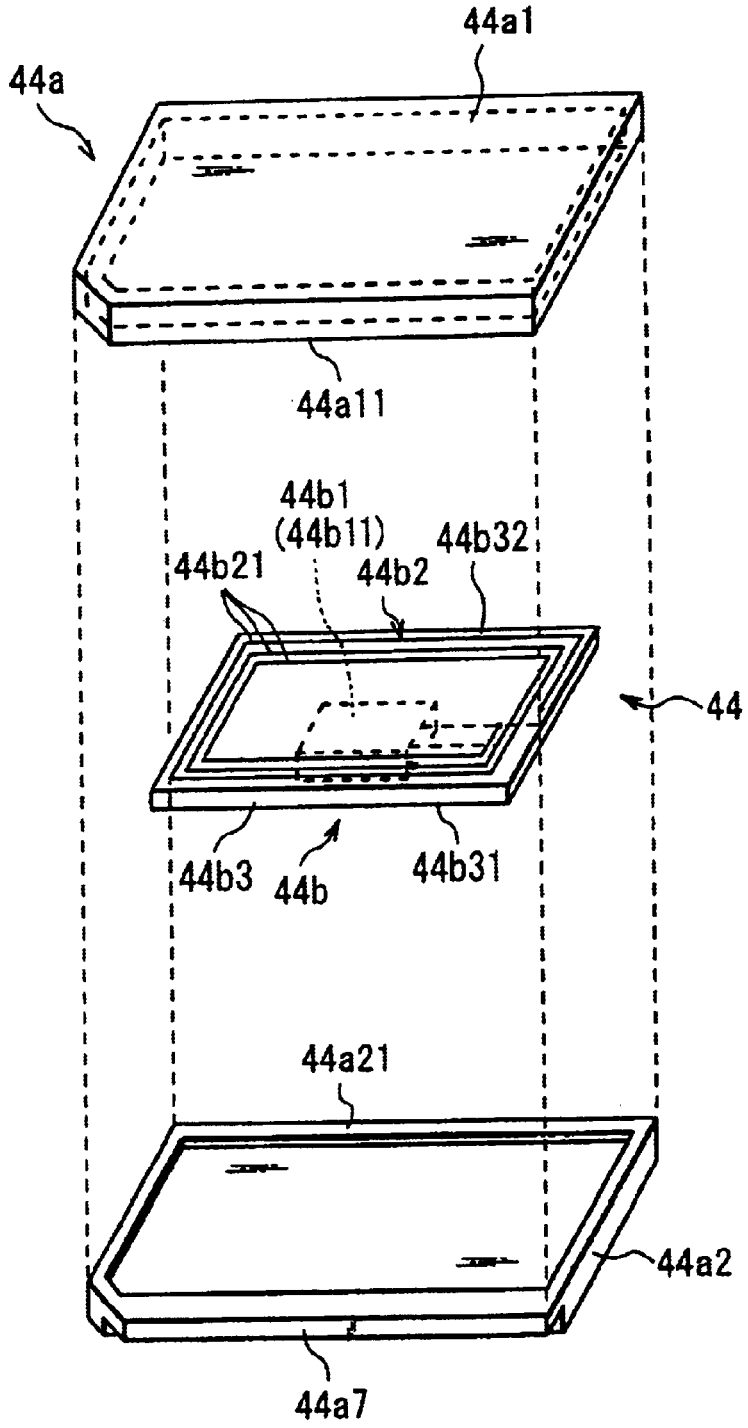
FIG. 12 is an exploded perspective view of a memory unit in which the storing element is distributed substantially at the center portion of the communication antenna on a back side of the substrate.
Figure 13:
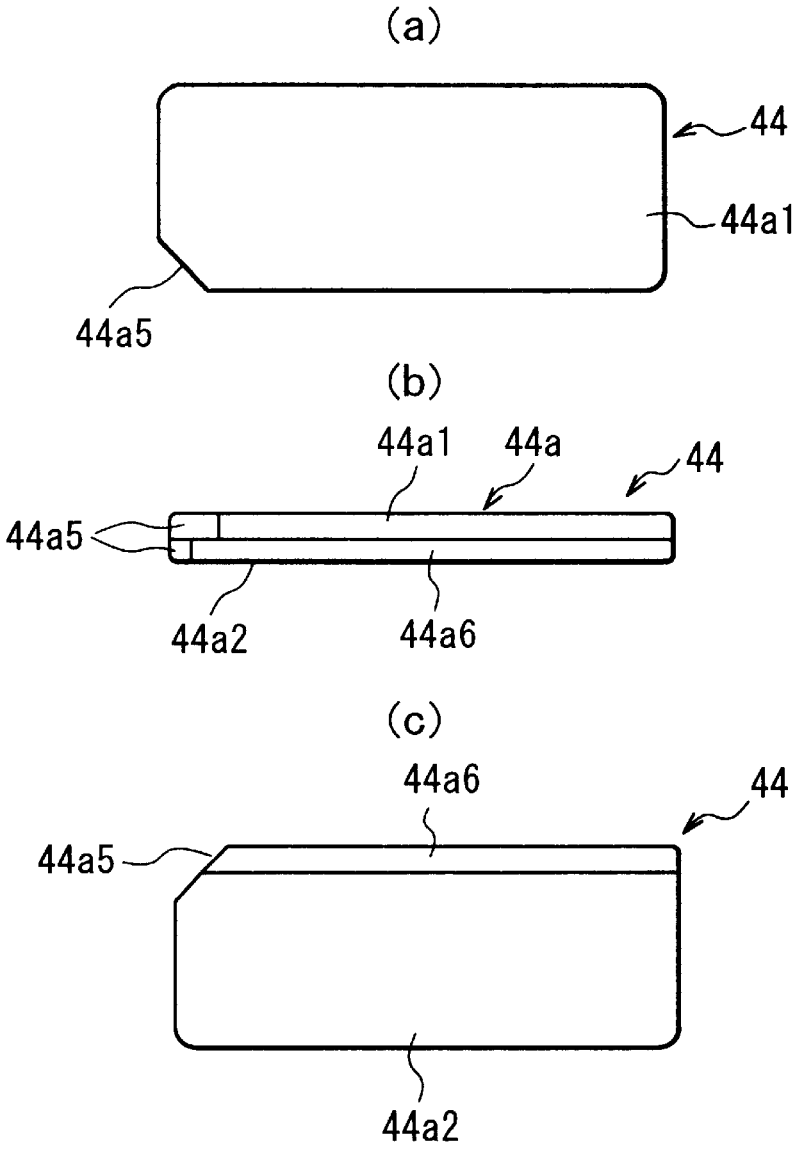
FIG. 13 shows a memory unit, wherein (a) is a top plan view; (b) is a front view; and (c) is a bottom view.
Figure 14:
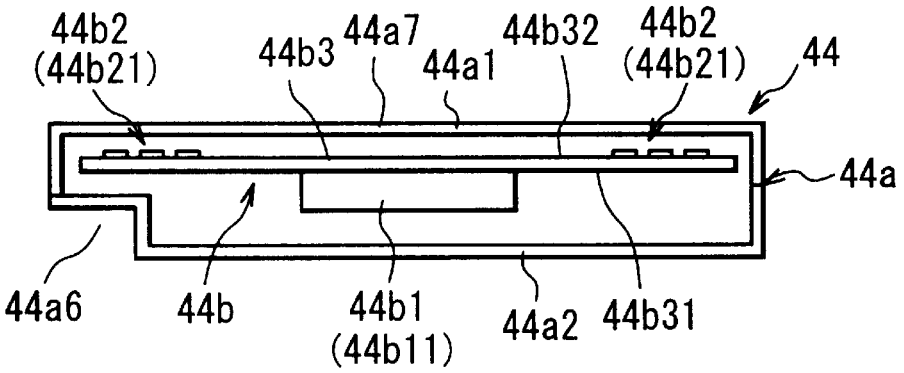
FIG. 14 is a sectional view of a memory unit shown in FIG. 12.

In the foregoing embodiments, the memory unit 44 has the unit 44*b* in which the storing element 44*b*1 is disposed outside the antenna 44*b*2. In this embodiment, the memory unit has a substrate unit in which the storing element is disposed inside the antenna. FIG. 12 is an exploded perspective view of a memory unit according to this embodiment of the present invention. FIG. 13 is an outer appearance of the memory unit shown in FIG. 12, in which a is a top plan view of the memory unit, b is a front view of the memory unit, and c is a bottom view of the memory unit. FIG. 14 is a sectional view of the memory unit shown in FIG. 12. The same reference numerals as with the foregoing memory unit are assigned to the corresponding elements.

As shown in FIGS. 12 and 13, the unit 44 of this embodiment is in the form of a tag comprising a substrate unit 44*b* and a frame member 44*a* as an outer casing member covering the substrate unit 44*b*. The substrate unit 44*b* includes a storing element 44*b*1 for storing information, an antenna 44*b*2 (magnetic core as a memory antenna) for communication and a substrate 44*b*3 for carrying the storing element 44*b*1 and the communication antenna 44*b*2, as a unit. The storing element 44*b*1 is provided on a rectangular substrate 44*b*3 made of epoxy resin material. More particularly, the storing element 44*b*1 is provided on a back side 44*b*31 of the substrate 44*b*3 (the side opposite from the side which faces the antenna unit 41 provided in the main assembly 14 of the apparatus), and is disposed inside a conduction pattern 44*b*21 constituting the antenna 44*b*2. More particularly, it is provided inside the pattern 44*b*21 substantially at the center portion of the back side of the substrate 44*b*3. The storing element 44*b*1 comprises a FERAM. The storing element 44*b*1 is integral with the sending circuit 44*b*11 functioning as the sending member shown in FIG. 15. The antenna 44*b*2 is provided on a surface 44*b*31 (the side facing the antenna unit 41 provided in the main assembly 14 of the apparatus) of the substrate 44*b*3. The antenna 44*b*2 has a pattern 44*b*21 in the form of a volute extending along the sides of the rectangular shape of the substrate 44*b*3. The pattern 44*b*21 is formed on the substrate 44*b*3 by pattern printing. The pattern 44*b*21 is connected with a storing element 44*b*1 (FERAM). The unit 44*b* thus constructed is disposed in the frame member 44*a*. The frame member 44*a* comprises an upper outer casing portion (upper frame 44*a*1) made of polystyrene resin material and a lower outer casing portion (lower frame 44*a*2). The upper frame 44*a*1 and the lower frame 44*a*2 are provided with projected portions 44*a*11, 44*a*21 at the circumference thereof. The projected portions 44*a*11, 44*a*21 of the upper frame 44*a*1 and the lower frame 44*a*2 are contacted to each other to constitute a frame member 44*a*.

The projected portions 44*a*11, 44*a*21 of the upper frame 44*a*1 and the lower frame 44*a*2 are fixed by an adhesive material, welding, ultrasonic welding or the like after the unit 44*b* is inserted. More particularly, the frame member 44*a* is made of a material having a dielectric constant of 2–5. The material of the non-electroconductive member may be the above-described polystyrene resin material, acrylic nytril butadiene resin material, polycarbonate resin material or the like.

Figure 15:
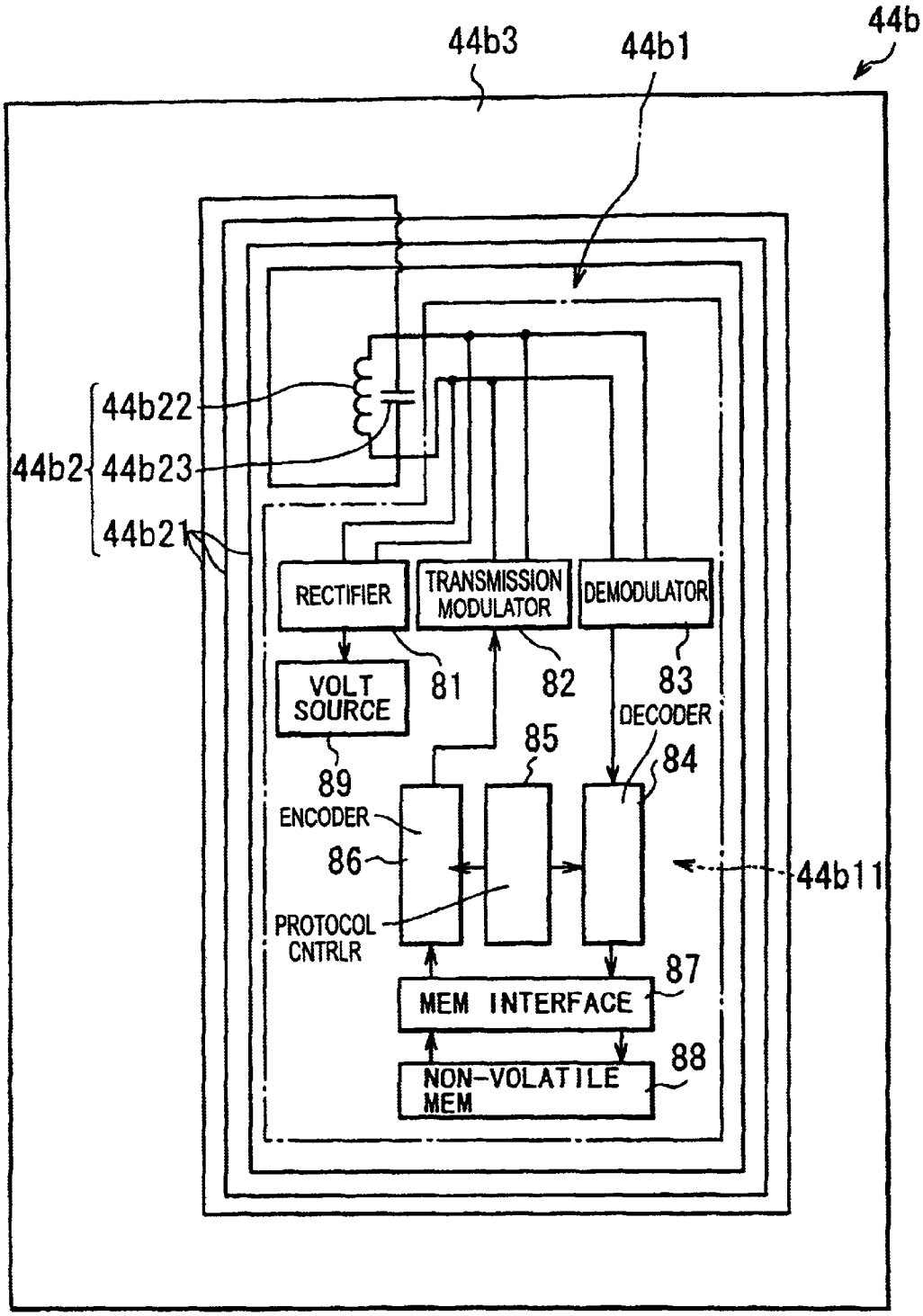
FIG. 15 shows an electric circuit diagram of the storing element.

Referring to FIG. 15, the description will be made as to the inner structure of the storing element 44*b*1.

FIG. 15 shows a circuit of a storing element. As shown in FIG. 15, the storing element 44*b*1 is formed integrally with a sending circuit 44*b*11 provided on the substrate 44*b*3. The circuit 44*b*11 functions to supply the information stored in the storing element 44*b*1 to the antenna 44*b*2. The antenna 44*b*2 comprises a coil 44*b*22, a capacitor 44*b*23 and an electroconductive pattern 44*b*21 in the form of a volute. To the antenna 44*b*2, there are connected a rectifying circuit 81 of the sending circuit 44*b*11, a sending modulation circuit 82 and a demodulation device 83. The output of the rectifying circuit 81 is connected to the voltage source circuit 89 to supply the electric energy to a non-volatile memory 88. It further comprises a decoder 84, a protcol controller 85, an encoder 86, a memory interface, a non-volatile memory 88 such as an EEPROM or a strong dielectric member memory. When the signal is demodulated from a high frequency signal to a base band signal by the demodulation device 83, it is converted to a signal proper for supply to the memory 88 in accordance with a control of the protcol controller 85 by the decoder 84. The circuit 87 classifies the signal into the address and the data, the reading and writing is carried out to and from the memory 88 in accordance with a read/write command. The data read out of the memory 88 is sent from the circuit 87 to the encoder 86, and is converted to a protocol proper to the communication, and then it is sent from the sending modulation circuit 82 to the antenna 44*b*2.

With such a structure of the memory unit 44, when the unit 44 is abutted to the antenna unit 41 provided in the main assembly 14 of the apparatus, the antenna 44*b*2 of the unit 44*b* can face the unit 41. Therefore, the distance between the antenna 41*c* and the antenna 44*b*2 can be minimized. Because of this, the level of the output of the antenna unit 41 provided in the main assembly 14 of the apparatus can be minimized.

In addition, the wireless communication distance between the antenna 41*c* and the antenna 44*b*2 can be minimized. Therefore, the wireless communication is substantially free of external disturbance such as noise, and therefore, the reliability in the communication is improved.

For example, in this embodiment, the distance between the antenna 41*c* (main assembly antenna) and the antenna 44*b*2 can be maintained at 1.75 mm–3.25 mm. The distance is merely an example, and the distance between the antennas 41*c*, 44*b*2 may practically be 1 mm–10 mm.

The storing element 44*b*1 is disposed inside the antenna 44*b*2. Therefore, the area of the unit 44*b* can be reduced. For this reason, the memory unit 44 can be downsized.

The unit 44*b* is covered with the frame member 44*a*. Therefore, the same advantageous effects as with the foregoing memory unit 44 can be provided in addition to the above-described advantageous effects.

(Second Embodiment)

Figure 16:
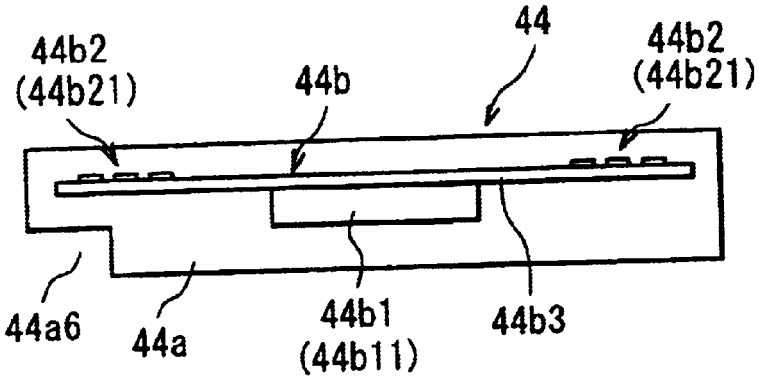
FIG. 16 is a sectional view of a memory unit shown in FIG. 9 according to a further embodiment.

FIG. 16 is a perspective view of a memory unit according to a second embodiment of the present invention.

In this embodiment, the frame member 44*a* covering the substrate unit 44*b* is produced from a resin material by an injection molding. More particularly, the unit 44 is produced by inserting the unit 44*b* into a mold of the resin material and ejecting the resin material in this state.

In this case, the same advantageous effects as with the first embodiment can be provided.

(Third Embodiment)

Figure 17:
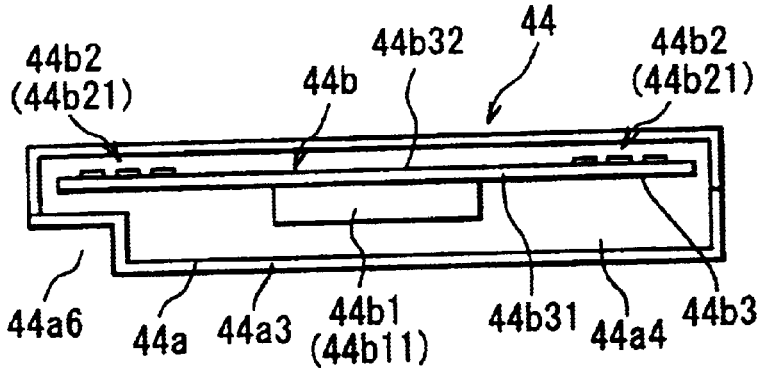
FIG. 17 is a sectional view of a memory unit shown in FIG. 12 according to a further embodiment of the present invention.

FIG. 17 is a sectional view of a memory unit according to a third embodiment of the present invention.

In this embodiment, a frame member 44*a* covering a substrate unit 44*b* is constituted by a resin material case 44*a*3, resin material injected in the resin material case 44*a*3 and an elastomer 44*a*4. In this embodiment, the unit 44 is produced by inserting the unit 44*b* into a resin material case 44*a*3 and injecting the elastomer 44*a*4 into the case 44*a*3 to fill it up.

In this case, the same advantageous effects as with the first embodiment can be provided.

In the foregoing embodiments, the substrate unit 44*b* comprises the storing element 44*b*1 having the circuit 44*b*11 and the antenna 44*b*2 which are disposed on the substrate 44*b*3 of epoxy resin material. However, it is an alternative that they are disposed on different substrates, and they are connected by metal contacts or leads or the like.

(Fourth Embodiment)

Figure 18:
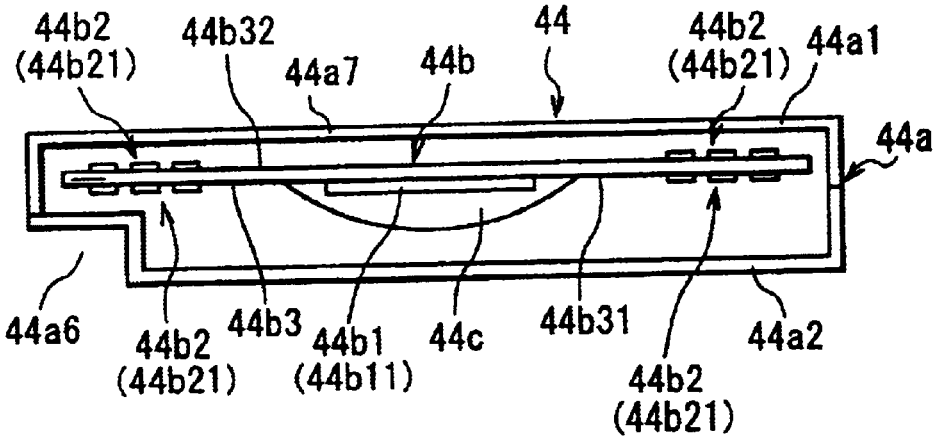
FIG. 18 is a perspective view of a memory unit provided with a beveled portion and a stepped portion.

In the foregoing abutments, the communication antenna 44*b*2 is provided only on the back side 44*b*31 of the substrate 44*b*3. In this embodiment, the memory unit memory member has a substrate unit in which a communication antenna is extended on both of the front and back sides of the substrate. FIG. 18 is a sectional view of a memory unit according to this embodiment of the present invention. The same reference numerals as with the memory unit of the first embodiment are assigned to the element having the corresponding functions.

Figure 19:
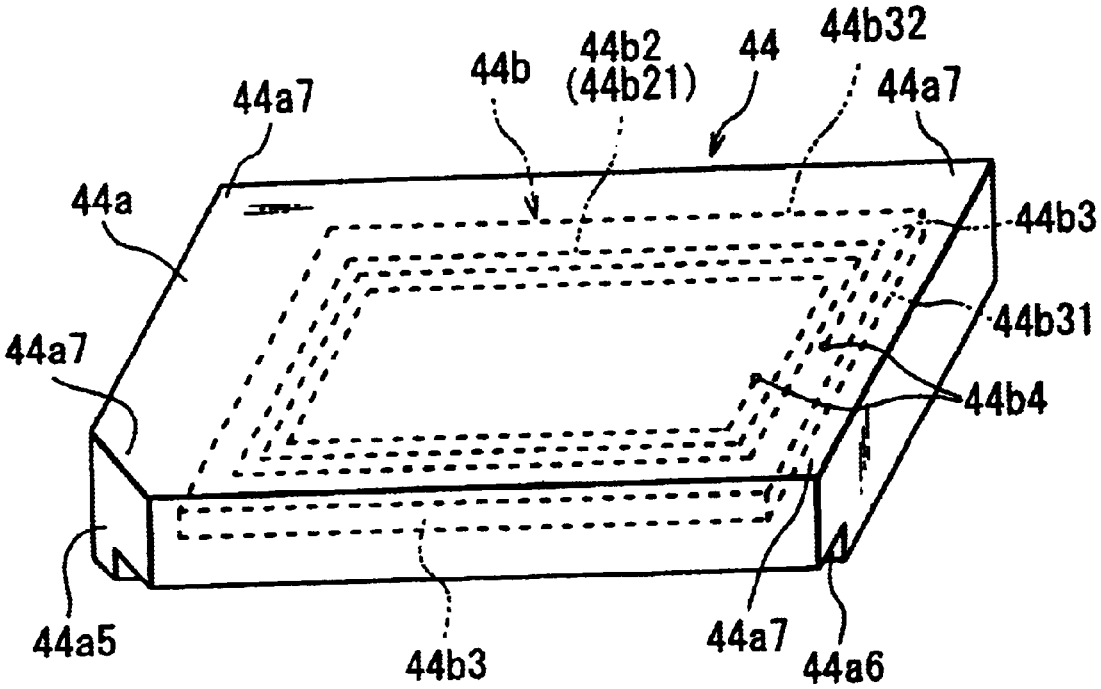
FIG. 19 is an illustration of a mounting portion provided in the process cartridge.

As shown in FIG. 18, the memory unit 44 of this embodiment comprises an electroconductive pattern 44*b*21 of the antenna 44*b*2 on the front surface 44*b*32 of the substrate (44*b*3 the surface to face the antenna unit 41 of the main assembly 14 of the apparatus) and on a back side 44*b*31 (the surface opposite from the front surface to be opposed to the antenna unit 41, namely, the surface having the storing element 44*b*1). More particularly, as shown in FIG. 19, the electroconductive pattern 44*b*21 of the antenna 44*b*2 penetrates the surface 44*b*32 of the substrate 44*b*3, and then through the substrate 44*b*3 to the back side 44*b*31 of the base 44*b*3. Then, it penetrates the back side 44*b*31 of the substrate 44*b*3 and then the substrate 44*b*3 back to the surface 44*b*32 of the substrate 44*b*3. Designated by reference numeral 44*b*4 is a hole for passing it, and is provided in the substrate 44*b*3. Through the hole 44*b*4, the electroconductive pattern 44*b*21 is electrically connected between the surface 44*b*32 side and the back side 44*b*31 side. One and the other ends of the electroconductive pattern 44*b*21 are electrically connected with the sending circuit 44*b*11 of the storing element 44*b*1. The pattern 44*b*21 is in the form of a volute extending along sides of the rectangular shape of the substrate 44*b*3 similarly to first embodiment. The storing element 44*b*1 is covered with and protected by a bonding 44*c* of a resin material on the substrate 44*b*3. In a manufacturing step of the substrate unit 44*b* or in a memory unit assembling step of assembling the upper frame 44*a*1, the lower frame 44*a*2 and the substrate unit 44*b*, the storing element 44*b*1 can be protected from external forces thereto. With this structure of the unit 44, similarly to the unit 44 of the first embodiment, when the unit 44 is abutted to the antenna unit 41 provided in the main assembly 14 of the apparatus, the antenna 44*b*2 in the substrate unit 44*b* can be face the antenna unit 41. Therefore, the distance between the antenna 41*c* (main assembly antenna) and the antenna 44*b*2 (memory antenna) can be minimized. In this embodiment, the distance between the antennas 41*c*, 44*b*2 is 1.75 mm–3.25 mm. This is effective to minimize the output of the antenna unit 41 provided in the main assembly 14 of the apparatus for the wireless communication. The minimization of the communication distance between the antenna 41*c* and the antenna 44*b*2 is effective to make the communication substantially free of external disturbances such as noise. Therefore, the reliability of the wireless communication can be improved. Additionally, the wireless communication is possible between the antenna 41*c* and the antenna 44*b*2 provided on both of the surface 44*b*32 and the back side 44*b*31 of the substrate 44*b*3, and this is effective to further improve the reliability of the wireless communication. By the provision of the antenna 44*b*2 on both of the front and back sides of the substrate 44*b*3, the number of windings of the antenna 44*b*2 can be increased. By doing so, the output of the antenna 44*b*2, that is, the intensity of the electromagnetic field can be enhanced.

The storing element 44*b*1 is disposed inside the antenna 44*b*2 on the substrate 44*b*3. This is effective to reduce the area of the substrate unit 44*b*. For this reason, the memory unit 44 can be downsized.

The substrate unit 44*b* is covered with a frame member 44*a*. Therefore, the same advantageous effects as with the foregoing memory unit 44 can be provided in addition to the above-described advantageous effects.

(Memory Unit Mounting Structure)

Figure 20:
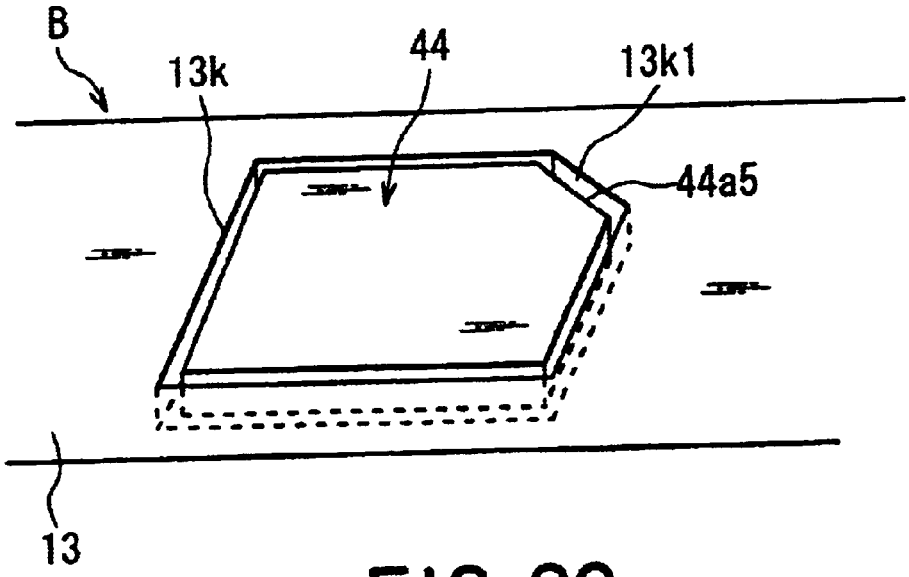
FIG. 20 is an illustration of a feeding guide for the memory unit.

Referring to FIGS. 19, 20, a the description will be provided as to a memory unit mounting structure.

FIG. 19 is a perspective view of a memory unit which is provided with a beveled portion and a stepped portion. FIG. 20 illustrates a memory unit mounting portion in the cartridge side.

When the memory unit 41 is mounted on a frame, it is desirable to provide a means to prevent the memory unit 41 from being mounted upside down or the memory unit 44 from being mounted in a wrong orientation. When the memory unit 41 is mounted upside down, the distance between the antenna 41*c* and the antenna 44*b*2 are different from the predetermined distance with the result of deterioration of the reliability in the communication. When the mounting orientation of the memory unit 44 is wrong, the correct facing between the antenna 41*c* and the antenna 44*b*2 is not accomplished with a result of deterioration of the reliability in the communication, again.

In order to assure the reliability of the communication between the antenna 41*c* and the antenna 44*b*2, it is desirable that the facing orientation of the memory unit 44 and the facing position are regulated.

In this embodiment, means are provided to determine the facing orientation and the facing position of the memory unit 44 relative to the antenna 41*c*. As shown in FIG. 19, a beveled portion 44*a*5 functioning as a regulating portion is provided at one of the corner portions 44*a*7 at the outer periphery of the frame member 44*a* of the memory unit 44. The beveled portion 44*a*5 is effective to regulate the mounting position or orientation of the memory member when it is mounted. As shown in FIGS. 1 to 4, the memory unit 44 faces the cleaning unit C. As shown in FIG. 20, the cleaner frame 13 of the cleaning unit C is provided with a memory unit mounting portion 13*k* for detachably mounting the unit 44. The memory unit mounting is provided at a position in which the memory unit 44 is faced to the antenna unit 41 in the inserting direction of the cartridge B. The memory unit mounting portion 13*k* is provided at a leading end portion of the cleaner frame 13 with respect to the cartridge mounting direction. The mounting portion 13*k* is provided with a beveled portion 13*k*1 functioning as a main assembly side regulating portion, at one of the inner corner portions. More particularly, it is substantially the same as the memory unit 44 in shape. The beveled portion 13*k*1 provided in the memory unit mounting portion 13*k* is complementary with the beveled portion 44*a*5 provided in one of the corner portions of the memory unit 44.

When the memory unit 44 is mounted to the memory unit mounting portion 13*k*, it is fitted into the memory unit mounting with the beveled portions 44*a*5, 13*k*1 aligned with each other in the mounting direction of the memory unit 44. By doing so, the facing orientation of the memory unit 44 relative to the communication antenna 41*c* or the facing position can be regulated. By doing so, an erroneous facing orientation of the memory unit 44 can be avoided during the mounting operation. In addition, erroneous mounting direction of the memory unit 44 does not occur during the mounting operation. The depth of the mounting portion 13*k* is substantially the same as the thickness of the unit 44.

(Assembling Method of Memory Unit and Feeding Guide Structure)

A description will be provided as to mounting 15 of the memory unit 44 to the cleaning unit C using an automatic assembling apparatus (unshown). In this case, a parts feeder may be used to align the unit 44. In the parts feeder, a great number of units 44 are carried on a supporting table, and the supporting table is vibrated to move the units while making them direct uniformly, and then feeding the units 44 to the finger portion of the automatic assembling apparatus. In this embodiment, the units 44 can be supplied to the automatic assembling apparatus using the parts feeder. To accomplish this, as shown in FIG. 19, the back side of the unit 44 is provided with a stepped portion 44*a*6 which functions as a guide portion (feeding guide). Here, the back side of the memory unit 44 is the surface opposite from the side to face the antenna unit 41 provided in the main assembly 14 of the apparatus when the unit 44 is mounted to the main assembly 14 of the apparatus. The stepped portion 44*a*6 is provided along one of the long sides of the unit 44 and is extended in the longitudinal direction of the unit 44. In other words, it is provided on an outer surface of the unit 44 having a substantially rectangular parallelopiped configuration and is extended in the longitudinal direction as shown in FIGS. 13, 14, 16–19, 21, and 22.

Figure 21:
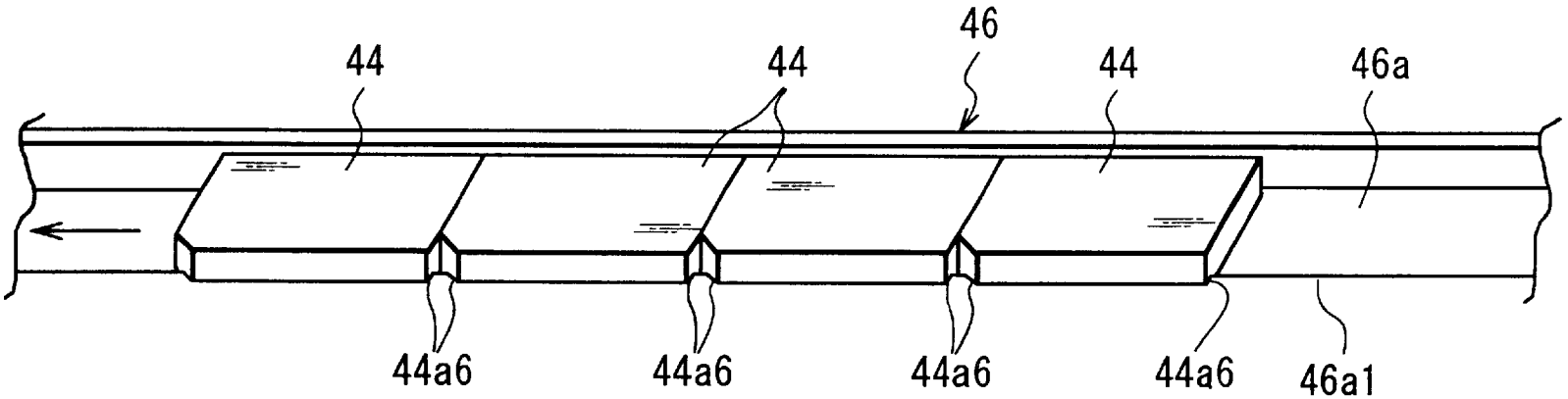
FIG. 21 is an illustration of a feeding type of a memory unit in a parts feeder.

FIG. 21 shows an example of the parts feeder for feeding the memory unit. FIG. 22 is a sectional view of a feeding guide of the parts feeder. As shown in FIG. 21, the parts feeder 46 comprises a feeding guide 46*a* which is in the form of a supporting table for carrying and moving a number of memory unit 44 by imparting vibration or the like. The feeding guide 46*a* is channel-shaped for guiding the outer surface of the unit 44 in the longitudinal direction, as shown in FIG. 22. The side of the feeding guide 46*a* which faces the bottom surface side of the unit 44, is provided with a guide stepped portion 46*a*1 which is extended in the longitudinal direction corresponding to the stepped portion 44*a*6. The guide stepped portion 46*a*1 is shaped such that when the unit 44 is on the feeding guide 46*a* with the back side thereof facing down, the guide stepped portion 46*a*1 supports the stepped portion 44*a*6 of the unit 44.

When the units 44 are supplied to the automatic assembling apparatus by the feeder 46, the units 44 are placed on the guide 46*a* of the feeder 46 with the back side thereof facing down, so that stepped portion 44*a*6 is supported by the guide stepped portion 46*a*1, as shown in FIG. 22. By doing so, the directions of the memory units 44 and the facing orientations thereof are correctly determined. Therefore, as shown in FIG. 21, the units 44 can be supplied properly to the automatic assembling apparatus along the guide 46*a*. Thus, by the provision of the stepped portion 44*a*6 at one side of the unit 44, the directions of the unit 44 and the facing orientations can be properly controlled.

Thus, the automatic assembling can be accomplished.

II. Disposition of Memory Unit

As shown in FIGS. 3 and 4, the memory unit 44 is mounted on the cleaning unit C. The wireless communication is carried out while it is abutted to the antenna unit 41 provided in the main assembly 14 of the apparatus. The unit 44 is mounted by a double coated tape, an adhesive material, heat crimping, ultrasonic welding, snap fit or the like such that it can be easily demounted from the cartridge B. The mounting of the unit 44 is strong enough to avoid unintended demounting, when the user touches the unit 44, or when the cartridge B is mounted to the main assembly 14 of the apparatus,.

(Memory Unit Mounting Structure (Center Portion Disposition of Memory Unit))

When the wireless communication is carried out with the memory unit 44 abutted to the antenna unit 41 provided in the main assembly 14 of the apparatus, it is desirable that its position is such that wireless communication is not easily influenced by radio waves from other electronic equipment (CRT or the like) placed in the neighborhood of the image forming apparatus A.

As shown in FIGS. 3 and 4, the memory unit 44 is disposed substantially at the center of the cleaning unit C (cartridge frame) in the longitudinal direction of the cartridge B (the axial direction of the photosensitive drum 7). When the cartridge B is inserted into the main assembly 14 of the apparatus, the unit 44 is abutted to the antenna unit 41 in the neighborhood of the center of the main assembly 14 of the apparatus, and the communication is carried out in this position as shown in FIG. 1. In other words, by mounting the unit 44 substantially at the center portion of the unit C in the longitudinal direction of the cartridge B, it is disposed at a position most remote from the outer casing surface of the main assembly 14 of the apparatus. As a result, even if another piece of electronic equipment is placed in the neighborhood of the image forming apparatus A, the wireless communication is not easily influenced by the electronic equipment, thus minimizing the influence of the radio waves.

The unit 44 is substantially at the center of the unit C in the longitudinal direction of the cartridge B. Therefore, when the unit 44 is abutted to the unit 41, the cartridge B can be smoothly inserted. More particularly, when the unit 44 is contacted to the unit 41, or when the cartridge B is inserted into the main assembly 14 of the apparatus, the resistance against insertion is uniform in the longitudinal direction of the cartridge B. Therefore, the cartridge B can be smoothly mounted.

(Structure of the Memory Unit Mounting Portion)

Referring to FIGS. 23–28, the structure of the mounting portion of the memory unit 44 will be described.

In order to recycle the cleaner frame 13 of the cartridge B (container recycling or material recycling), it is desirable that unit 44 is dismounted without damage to the cleaner frame 13. This is because if the memory unit 44 containing the substrate unit 44*b* comprises the electrical part, the container recycling or the material recycling of the cleaner frame 13 made of a resin material is difficult.

In view of this, in this embodiment, the memory unit mounting portion 13*k* is so constructed that memory unit 44 can be easily dismounted. In addition, the structure is such that unit 44 can be easily dismounted from the mounting portion 13*k*. The unit 44 is demountably mounted to the cleaner frame 13. These embodiments will be described.

(First Embodiment)

As shown in FIG. 23, the mounting portion 13*k* is provided on an inner surface facing a side surface of the unit 44 with an inclined surface 131 tool inserting portion for permitting insertion of a tool. The inclined surface 131 is expanded toward an inlet of the mounting portion 13*k* from a bottom surface of the mounting portion 13*k*. With this structure, the unit 44 can be easily dismounted from the inclined surface 131. The unit 44 is mounted on the bottom surface of the mounting portion 13*k* by a double coated tape (bonding member). The memory unit 44 may be dismounted by a minus type screwdriver, for example. The mounting operation, the end of the minus type screwdriver is inserted between the bottom surface of the mounting portion 13*k* and the back side of the unit 44 along the inclined surface 131 of the mounting portion 13*k*, so that unit 44 is raised from the mounting portion 13*k*.

Thus, the unit 44 is dismounted from the cleaner frame 13. In order to prevent direct contact of the unit 44 to something during transportation and/or due to unintentional dropping upon mounting-and-demounting of the cartridge B, the surface of the unit 44 is stepped down from the surface of the cleaner frame 13, or the cleaner frame 13 is made to cover a part of the surface of the unit 44.

(Second Embodiment)

As shown in FIG. 24*a* and *b*, the recess functioning as a mounting portion 13*k*, has a size slightly larger than that of the unit 44. By doing so, there is provided a gap between the inner surface of the mounting portion 13*k* and the outer surface of the unit 44.

A width 13*m* of the bottom surface on which the memory unit 44 is fixed is made smaller than the width 13*n* of the memory unit 44. By this, a tool inserting portion 13*u* in the form of a groove portion is provided to the insertion of the tool, around the bottom surface. The unit 44 is mounted on the bottom surface of the mounting portion 13*k* by a double coated tape. In the demounting operation, the end of the minus type screwdriver tool is inserted into the portion 13*u* of the mounting portion 13*k*, and the unit 44 is raised from the bottom surface of the mounting portion 13*k* using a lever function.

By doing so, the unit 44 is dismounted from the cleaner frame 13.

As shown in FIG. 25*a* and *b,* the mounting portion 13*k* is provided with recesses 13*v* (stepped portion) tool inserting portion in order to permit insertion of the tool to a part of the inner surface opposed to the opposite ends of the unit 44. The recesses 13*v* are formed toward the cleaner frame 13. The unit 44 is mounted on the bottom surface of the mounting portion 13*k* by a double coated tape. In the demounting operation, the end of the minus type screwdriver tool is inserted into recess 13*v*, and the unit 44 is raised from the bottom surface of the mounting portion 13*k* using a lever function. By doing so, the unit 44 is dismounted from the cleaner frame 13.

Figure 26:
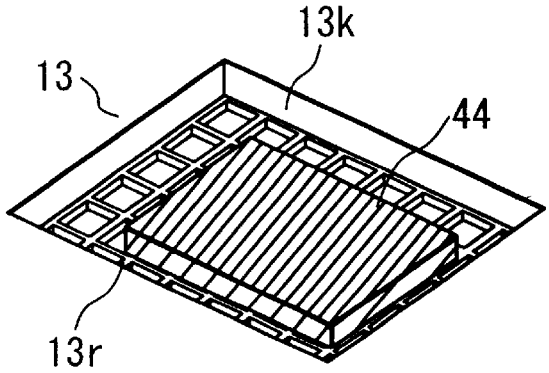
FIG. 26 is an illustration of a memory unit mounting portion having a tool inserting portion according to a fourth embodiment of the present invention.

As shown in FIG. 26, the mounting portion 13*k* is provided with a rib 13*r* tool inserting portion to permit insertion of the tool to the bottom surface facing the back side of the unit 44. The rib 13*r* is projected from the bottom surface of the mounting portion 13*k*, and forms a grid-like pattern. By the provision of such a grid-like pattern, the contact area relative to the unit 44 can be made smaller, thus accomplishing easy demounting of the unit 44. The unit 44 is mounted on the grid-like rib 13*r* of the mounting portion 13*k* by a double coated tape. In the demounting operation, the minus type screwdriver tool is inserted into the space between the portions of the rib 13*r* to which the unit 44 is mounted, and the unit 44 is raised from the bottom surface of the mounting portion 13*k* using a lever function. Thus, the unit 44 is dismounted from the cleaner frame 13.

(Third Embodiment)

Figure 27:
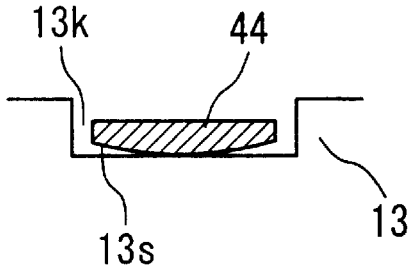
FIG. 27 is an illustration of a memory unit having a tool inserting portion.

In this embodiment, the memory unit is provided with means to permit tool insertion. FIG. 27 shows a memory unit according to this embodiment of the present invention. As shown in FIG. 27, the memory unit 44 is provided with an inclined portion 13*s* tool inserting portion to permit insertion of a tool to a corner portion at the bottom side of the mounting portion 13*k* provided in the cleaner frame 13. The inclined portion 13*s* is beveled. The unit 44 is mounted on the bottom surface of the mounting portion 13*k* by a double coated tape.

In the demounting operation, an end of the minus type screwdriver tool is inserted to the inclined portion 13*s*, and the unit 44 is raised from the bottom surface of the mounting portion 13*k* using a lever function. Thus, the unit 44 is dismounted from the cleaner frame 13.

(Fourth Embodiment)

Figure 28:
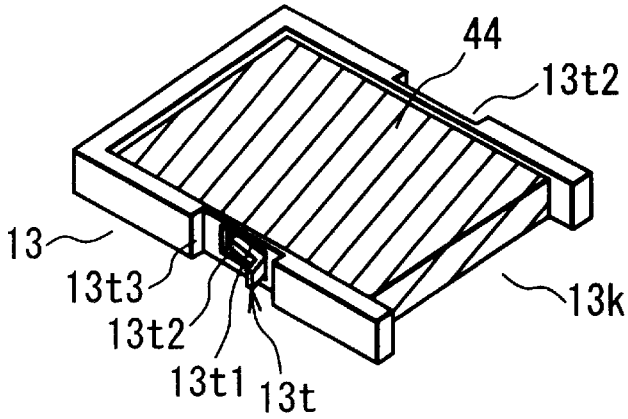
FIG. 28 is an illustration of a snap fitting for mounting the memory unit to the cleaner frame.

In this embodiment, the memory unit 44 is detachably mountable on the cleaner frame 13. FIG. 28 shows a structure of a memory unit mounting portion using the snap-fit. The memory unit 44 is provided with a snap 13*t*1 in the form of an elastic segment constituting a part of the snap fitting 13*t* structure. The cleaner frame 13 is provided with the mounting portion 13*k*, a locking hole 13*t*2 which is a locking portion structuring a part of the snap fitting 13*t*, and an insertion groove (tool inserting portion) 13*t*3 for permitting insertion of a screwdriver tool for the purpose of disengaging the snap 13*t*1 from the locking hole 13*t*2. When the unit 44 mounted to the cleaner frame 13, the unit 44 is engaged into the mounting portion 13*k* to bring the snap 13*t*1 into engagement with the locking hole 13*t*2. When the unit 44 is dismounted from the cleaner frame 13, an end of the screwdriver is inserted into the groove 13*t*3 to press the snap 13*t*1 locked with the locking hole 13*t*2 to release the engagement with the locking hole 13*t*2. By doing so, the unit 44 can be dismounted from the cleaner frame 13.

(Fifth Embodiment)

The mounting of the memory unit 44 to the cleaner frame 13 is not limited to the use of the double coated tape. For example, an adhesive material, heat crimping, ultrasonic welding or the like are usable. What is required is that unit 44 is easily dismounted from the mounting portion 13*k* of the cleaner frame 13 using a tool or another element.

Using the structure shown in FIGS. 23–28, the memory unit 44 can be dismounted without damage to the cleaning frame 13. Thus, the container recycling and/or material recycling of the cleaner frame 13, namely, recycling thereof is enabled.

(Structure for Protection of Memory Unit)

Figure 29:
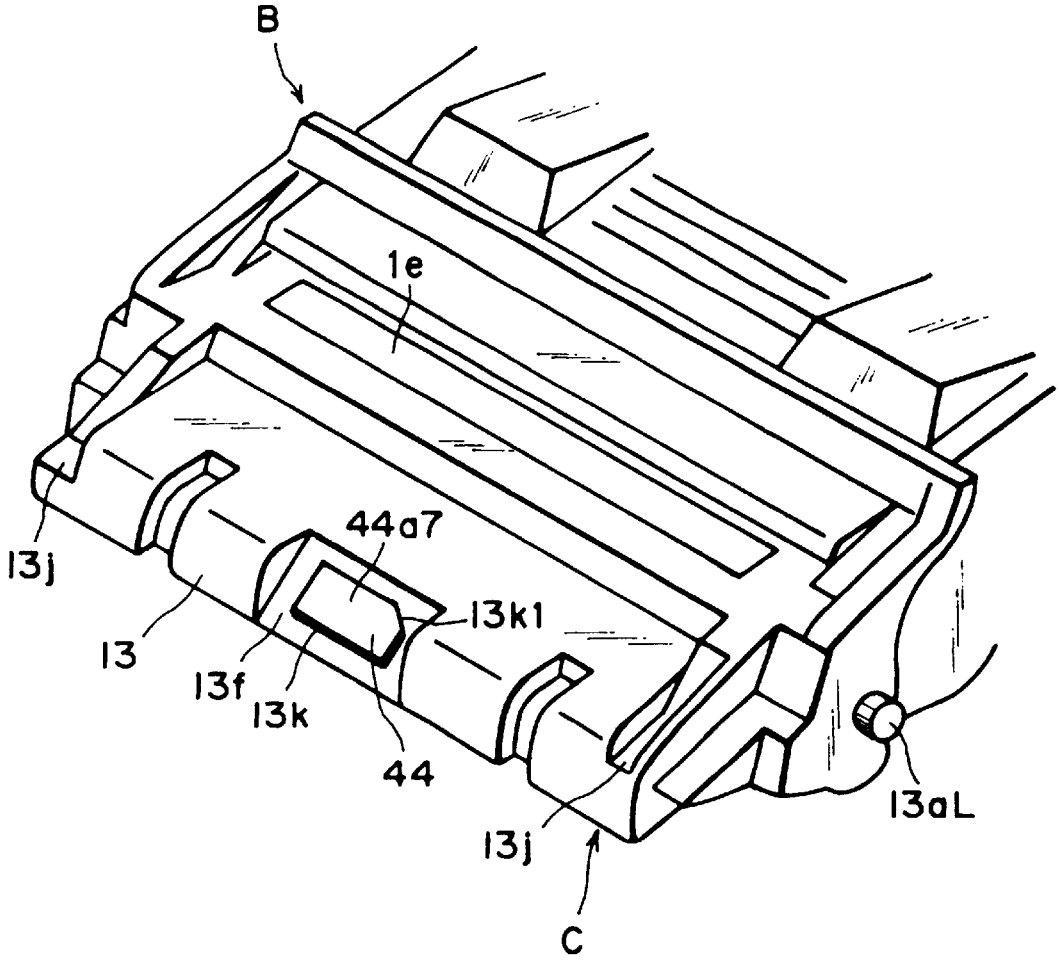
FIG. 29 is an illustration of an example of a process cartridge having a recess for protecting the memory unit.
Figure 30:
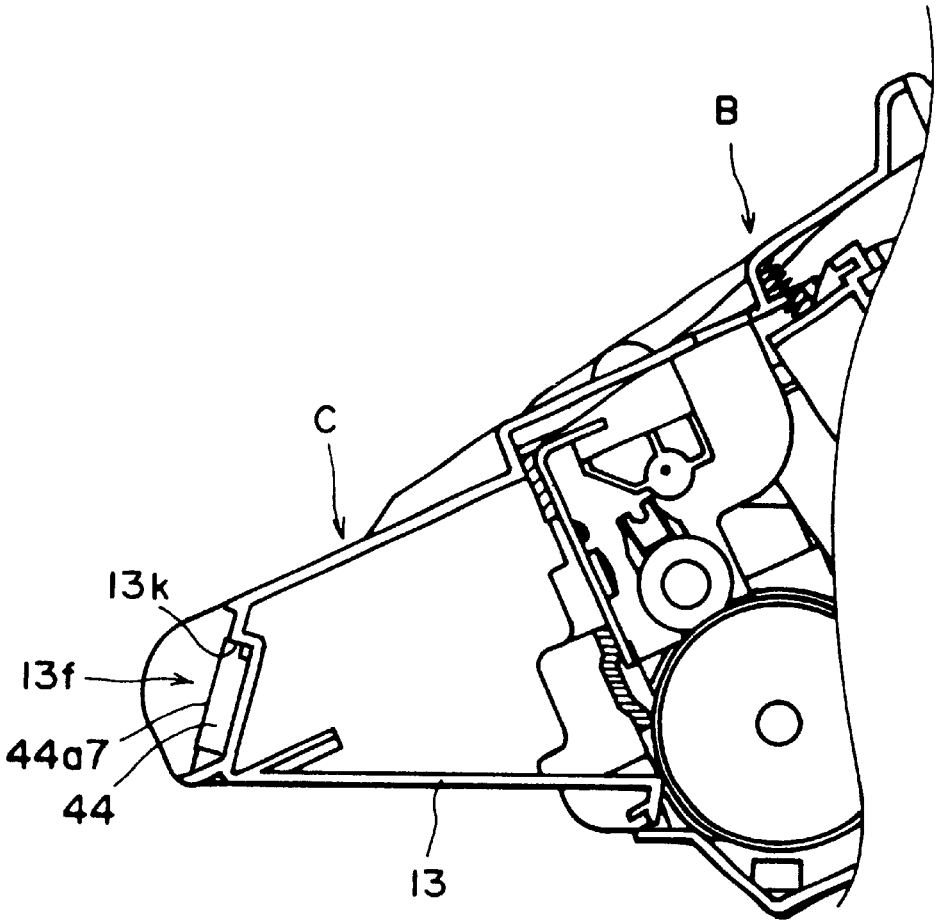
FIG. 30 is a sectional view of a process cartridge shown in FIG. 28.
Figure 31:
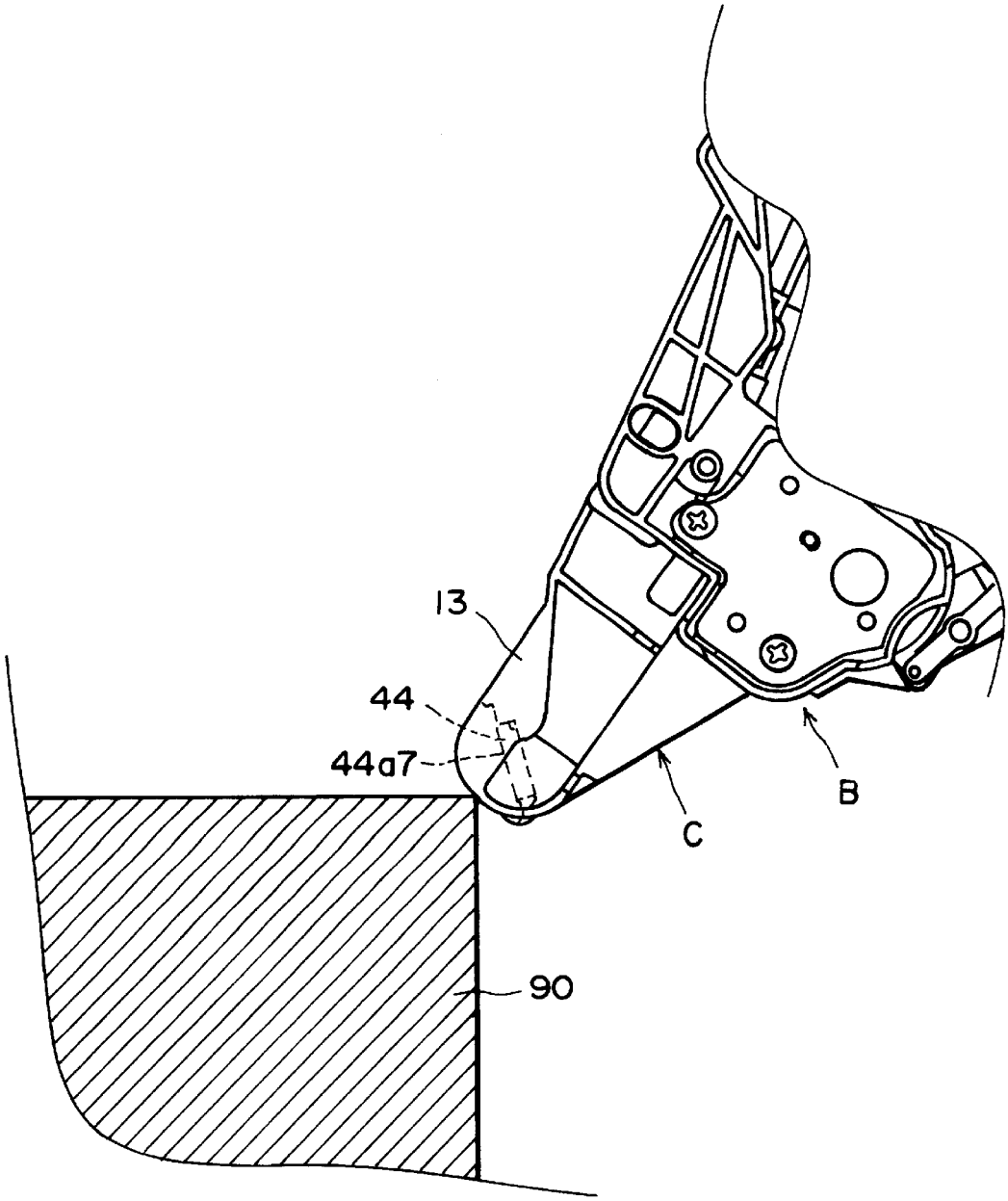
FIG. 31 is an illustration of protection of the memory unit.
Figure 32:
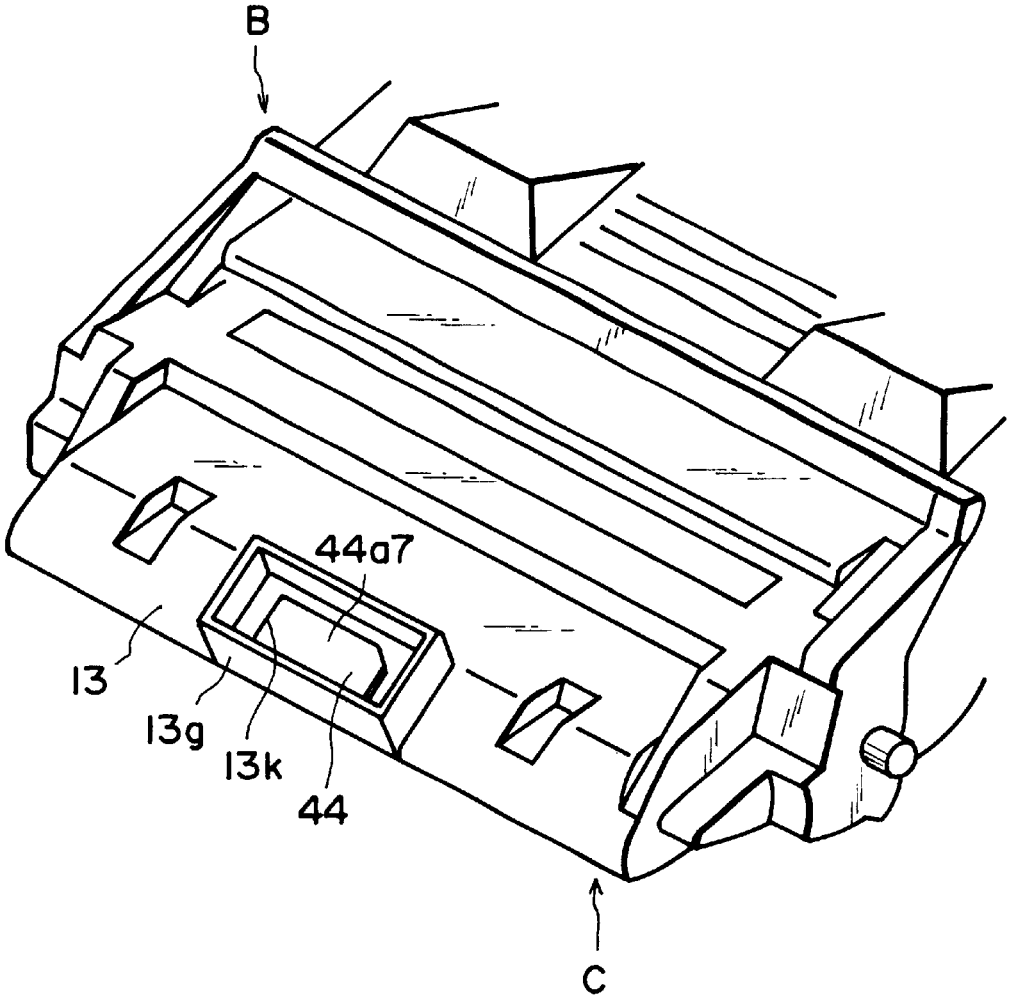
FIG. 32 is an illustration of an example of a process cartridge having a projection for protection of the memory unit.
Figure 33:
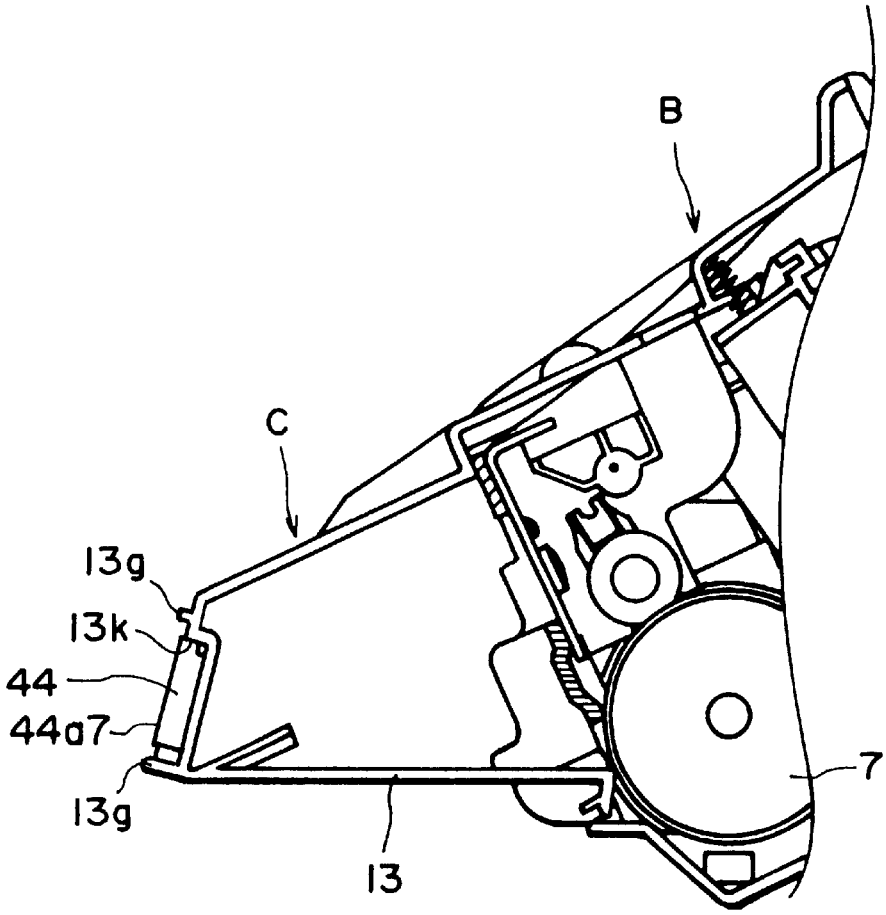
FIG. 33 is a sectional view of a process cartridge shown in FIG. 32.

Referring to FIGS. 29 to 33, a description will be provided as to a structure for protection of the memory unit 44. FIG. 29 is a perspective view of a cartridge having a recess for protection of the memory unit, FIG. 30 is a sectional view of the cartridge shown FIG. 29, FIG. 31 is an illustration of protection of the memory unit, FIG. 32 is a perspective view of a cartridge having a projection for protection of the memory unit, and FIG. 33 is a sectional view of the cartridge shown in FIG. 32.

The storing element 44*b*1 of the unit 44 stores information for execution of the image forming operation of the image forming apparatus A. Therefore, for the purpose of desirable correction of the image forming apparatus A, the unit 44 is without a problem. One of the causes of the problem or defect of the unit 44 is a shock or impact to the unit 44. In order to avoid the shock, it is desirable to provide a structure for protection of the unit 44.

As shown in FIG. 29, according to this embodiment, a protection recess 13*f* is provided at a position where the antenna unit 41 faces the cleaner frame 13 of the cleaning unit C to protect the memory member. More particularly, the recess 13*f* is disposed substantially at the center of the cleaner frame 13 facing the antenna unit 41 when the cartridge B is inserted in the longitudinal direction of the cartridge B to be mounted to the main assembly 14 of the apparatus. The depth of the recess 13*f* is larger than the thickness of the unit 44. The memory unit 44 is disposed in the recess 13*f*. The bottom surface of the recess 13*f* is provided with the mounting portion 13*k* previously described, the unit 44 is mounted on the mounting portion 13*k* using a double coated tape or another method. The recess 13*f* is larger in the longitudinal direction of the cartridge B than the size of the antenna unit 41. Therefore, when the cartridge B is mounted to the main assembly 14, the antenna unit 41 can enter the recess 13*f*.

Accordingly, part of the leading side surface 41*d* of the antenna unit 41 is contacted to the whole surface of the leading side surface 44*a*7 of the memory unit 44 mounted in the recess 13*f*. Thus, when the cartridge B is mounted to the main assembly 14 of the apparatus, the memory unit 44 is abutted to the antenna unit 41 at the leading side with respect to the mounting direction X1. The distance between the antenna 41*c*, 44*b*2 of the memory unit 44 and the antenna unit 41 is maintained by the abutment between the surfaces 41*d*, 44*a*7 and by a function of an equalizer mechanism 70. Here, the leading side surface 41*d* of the unit 41 is such a surface as is faced frontward when the cartridge B is mounted in the mounting direction X1. More particularly, the leading side surface 41*d* is the surface which is disposed downstream (rear side) with respect to the mounting direction X1. The leading side surface 44*a*7 of the memory unit 44 is the surface which is disposed at the leading side in the mounting direction X1 when the cartridge B is mounted to the main assembly 14 of the apparatus. The leading side surface 44*a*7 of the memory unit 44 is the upstream side front side surface with respect to the mounting direction X1.

When the leading side surface 44*a*7 is not flat as in this embodiment, namely, when the leading side surface is a projection or a recess, the projected portion on the leading side surface 44*a*7 is brought into contact with the leading side surface 41*d*.

By this contact, the distance between the antenna 41*c* and the antenna 44*b*2 is determined.

By disposing the unit 44 in the recess 13*f* of the cleaner frame 13, the unit 44 can be protected from the direct impact to the unit 44. As shown in FIG. 31, for example, even if the cleaning unit C of the cartridge B hits a corner of a desk 90, the unit 44 is not subjected to a direct impact since the unit 44 is provided in the recess 13*f* of the cleaner frame 13. Therefore, the frame member 44*a* of the unit 44 and therefore the information written in the storing element 44*b*1 are protected from damage.

As shown in FIGS. 32 and 33, a rib 13*g* (protecting projection) may be provided so as to enclose the outer periphery of the unit 44 to protect the memory member at a position where the cleaner frame 13 is opposed to the unit 41. The height of the rib 13*g* is larger than the thickness of the memory unit 44, by the provision of the rib 13*g* which enclosed the outer periphery of the unit 44, and by disposing the unit 44 in the area enclosed by the rib 13*g*.

In this embodiment, when the cartridge B is mounted to the main assembly 14 of the apparatus, the antenna unit 41 enters the area enclosed with the rib 13*g*. By doing so, the memory unit 44 and the antenna unit 41 are abutted to each other.

As described in the foregoing, the unit 44 is detachably mounted to the mounting portion 13*k* provided in the cleaner frame 13 with a proper mounting means such as a double coated tape. Accordingly, the unit 44 is prevented from disengaging from the cleaning unit C upon contact to the unit 41.

III. Abutting Structure Between Memory Unit and Antenna Unit

In order to accomplish the wireless communication while the antenna unit 41 and the memory unit 44 are contacted to each other, it is desirable that antenna 41*c* and the antenna 44*b*2 are opposed to each other with high accuracy.

Figure 34:
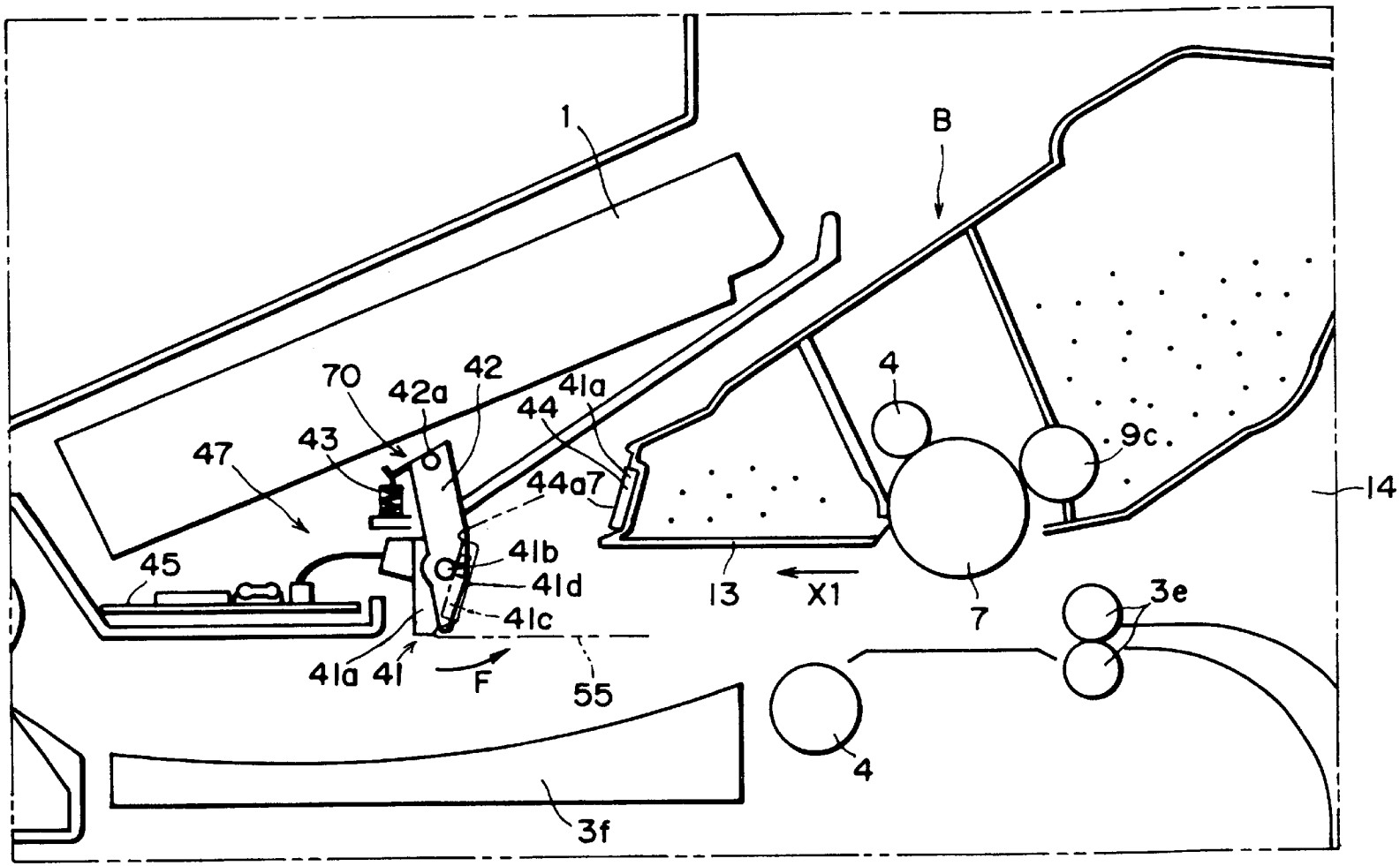
FIG. 34 is an illustration of an abutment structure between the memory unit and the antenna unit.

In this embodiment, as shown in FIG. 34, the main assembly 14 of the apparatus is provided with an equalizer mechanism 70 which functions as a positioning means. The unit 41 is held rotatably on an antenna unit supporting member 42 of the equalizer mechanism 70.

Figure 35:
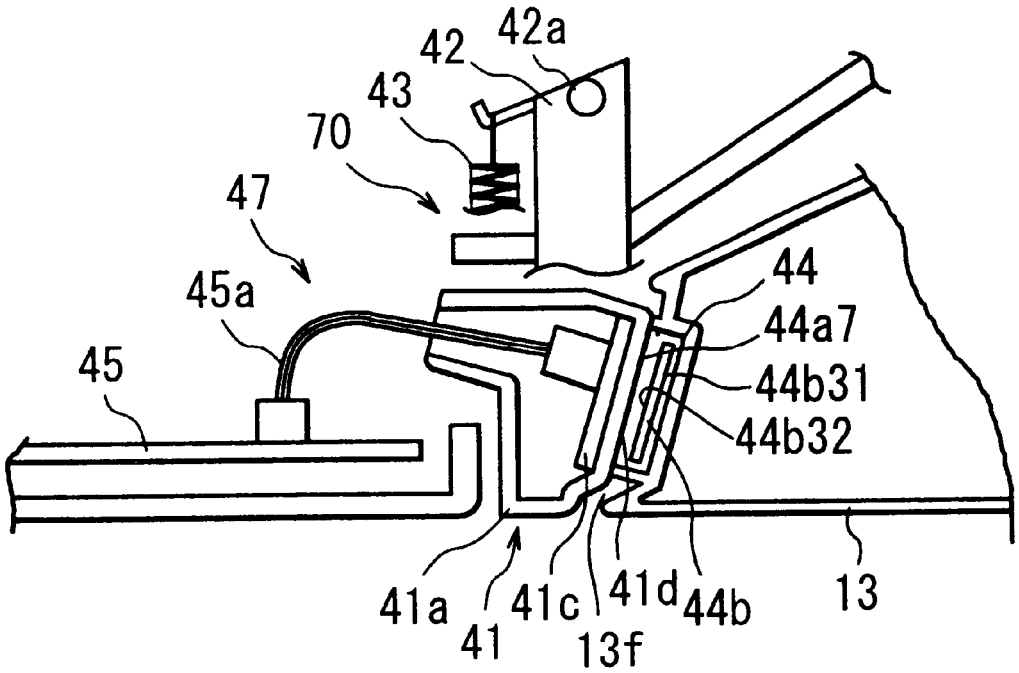
FIG. 35 is an enlarged sectional view of the abutting portion between the memory unit and the antenna unit shown in FIG. 34.

As shown in FIGS. 34 and 35, the unit 41 includes an antenna 41*c* and an antenna cover 41*a* functioning as an outer casing member covering the antenna 41*c*. The supporting member 42 is provided with an antenna cover 41*a* so as to be rotatable about a supporting shaft 41*b*. The supporting member 42 is mounted on the main assembly 14 of the apparatus, for rotation about the supporting shaft 42*a*. The supporting member 42 is supported by an electroconductive spring electroconductive member 43 which is locked to the main assembly 14 of the apparatus at the other end thereof. The supporting member 42 is urged by an elastic force tension of the spring 43 in the direction toward the insertion path 55 for the cartridge B arrow F direction about the supporting shaft 42*a*. Thus, when the cartridge B is not mounted in the main assembly 14 of the apparatus, the unit 41 is placed in the insertion path of the cartridge B by the supporting member 42. By this, when there is no cartridge B, the unit 41 is at a position within a region in which the memory unit 44 is present when the cartridge B is mounted to the main assembly of the apparatus (the region is the one occupied by the unit 44 when the cartridge B is completely inserted into the main assembly 14 of the apparatus).

As shown in FIG. 34, when the cartridge B is inserted into the main assembly 14 of the apparatus, the unit 41 enters the recess 13*f* of the cartridge B. When the cartridge B is further inserted, the supporting member 42 rotates about the supporting shaft 42*a* in the direction of insertion of the cartridge B with the insertion of the cartridge B. Then, the unit 41 is retracted from the insertion path of the cartridge B. As described hereinbefore, the unit 41 is abutted to the unit 44 when the cartridge B is completely inserted into the main assembly 14 of the apparatus as shown in FIG. 35. At this time, as described hereinbefore, the unit 41 is equalized so that abutment surfaces leading side surfaces 41*d*, 44*a*7 of the unit 41 and the unit 44 are parallel with each other, since the unit 41 is rotatable about the supporting shaft 41*b*. By this, the unit 41 is aligned with the position of the unit 44 so that in the position is determined so as to be opposed to the unit 44. In other words, the whole surface of the abutment surface of the memory unit 44 front side surface 44*a*7 is abutted to a part of the abutment surface front side surface 41*d* of the antenna unit 41.

With this structure, when the cartridge B is mounted to the main assembly 14 of the apparatus, the unit 41 and the unit 44 are correctly positioned relative to each other with high precision. Therefore, the antenna 41*c* and the antenna 44*b*2 are opposed to each other with high precision.

The positioning relative to the main assembly 14 of the apparatus of the cartridge B is effected by the regulating abutment 13*j* provided on the upper surface 13*i* of the cleaning unit C and the cylindrical guides 13*a*R, 13*a*L provided on the cleaning unit C. Therefore, by mounting the memory unit 44 to the cleaning unit C, the unit 44 is correctly positioned in the longitudinal direction and in the direction perpendicular thereto relative to the antenna unit 41 provided in the main assembly 14 of the apparatus.

In this embodiment, the antenna unit 41 is rotatable. However, it is an alternative that memory unit 44 is rotatable. More specifically, the memory unit 44 is made rotatable by providing an elastic member such as a spring, a sponge, a rubber material or the like between the memory unit 44 and the cleaning unit C.

IV. Wireless Communicating Mechanism

Referring to FIGS. 1, 7, 8, 36, and 37, a description will be provided as to the structure of the wireless communicating mechanism.

(General Arrangement of the Wireless Communicating Mechanism)

The wireless communicating mechanism comprises a communicating unit 47 and a memory unit 41.

Figure 7:
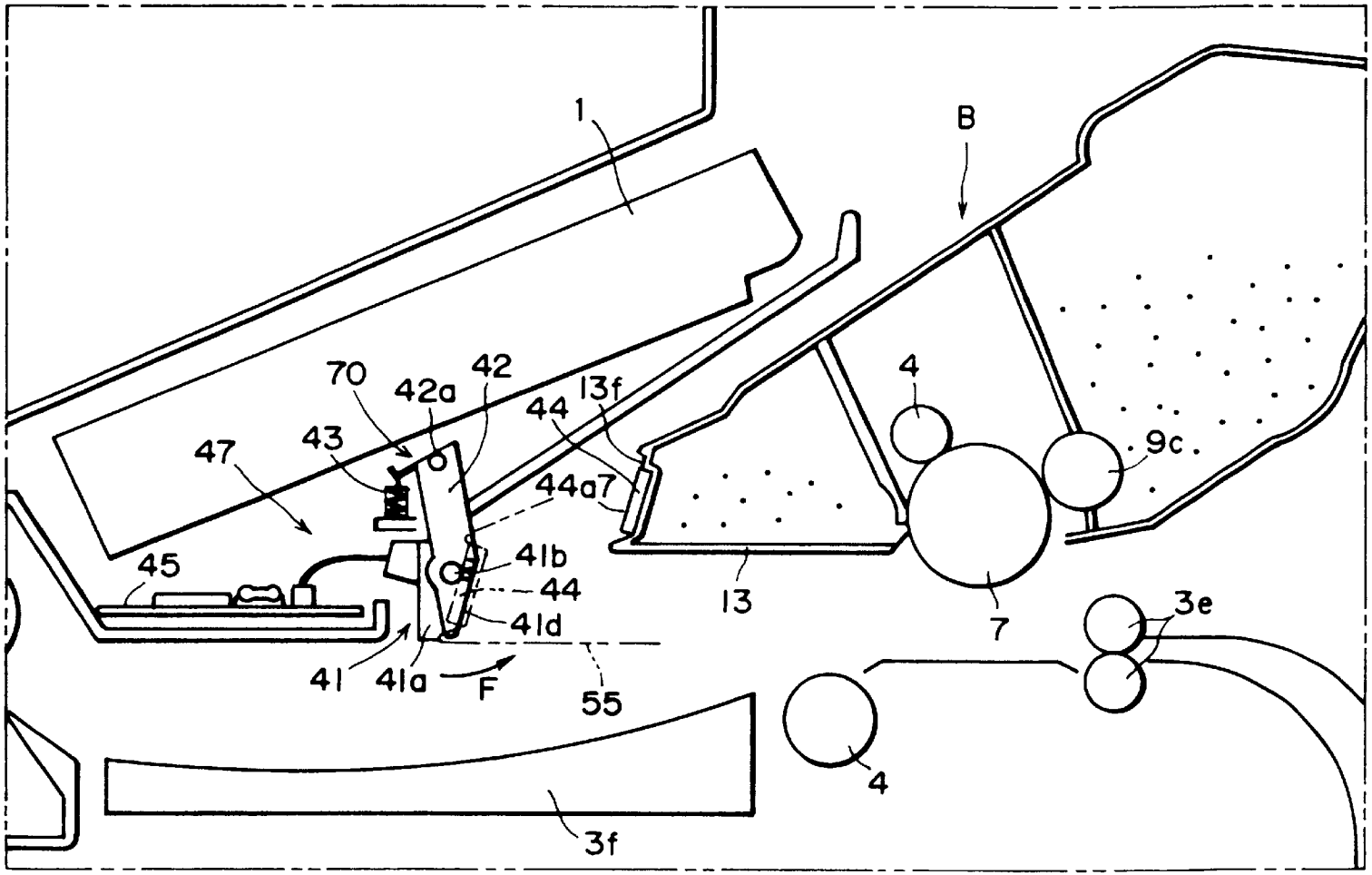
FIG. 7 is an illustration of a positional relation between the memory unit and the communicating unit in a process of insertion of the process cartridge into the main assembly of the apparatus.
Figure 8:
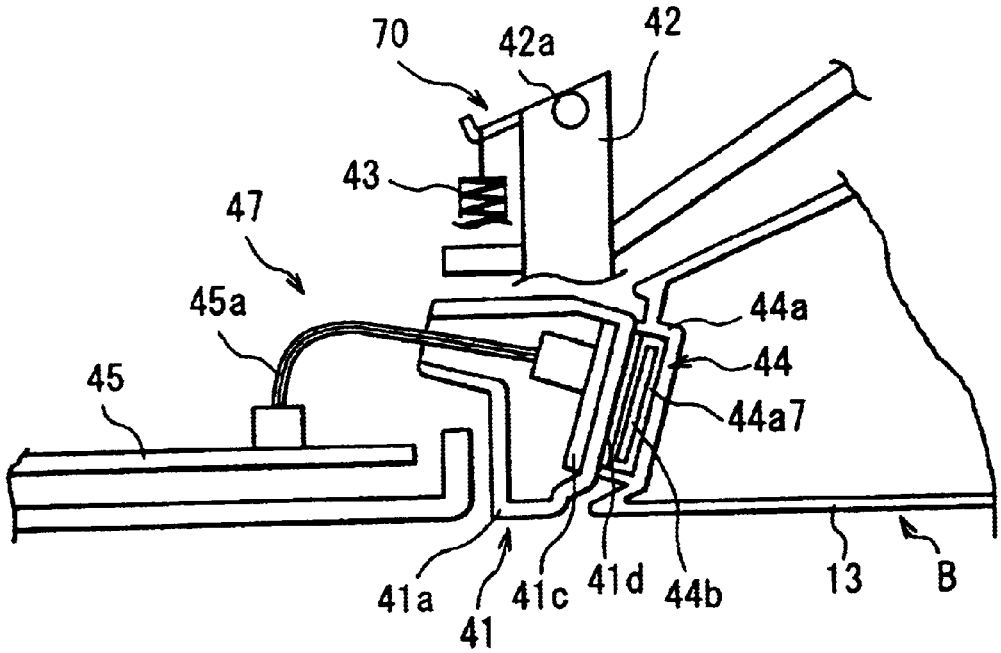
FIG. 8 is an illustration of the antenna unit of a communicating unit being brought into contact to the memory unit.

The unit 47, as described hereinbefore, comprises an antenna unit 41, a unit 45 for controlling the unit 41 and an equalizer mechanism 70 (FIGS. 7, 8). The unit 41 and the unit 45 are electrically connected by a signal line 45*a*. The unit 41 comprises an antenna substrate 41*c* and an antenna cover 41*a* as an outer casing member covering the antenna substrate 41*c*. The material of the antenna cover 41*a* is selected from such materials as have a physical strength against the abutment to the memory unit 44 and as have a sufficient electrostatic shield property (dielectric constant 2–5 desirably). This means that material may be the same as the material of the frame member 44*a* of the memory unit 44.

The unit 41 is urged to be positioned in the insertion path 55 of the cartridge B by the supporting member 42, and is positioned by abutment to the memory unit 44. The writing of the information into the memory unit 44 and the reading of the information from the memory unit 44 are carried out in response to instructions from the controlling unit 48 shown in FIG. 1 by the communication controlling unit 45 acting on the memory unit 44 through the antenna unit 41.

(Urging Mechanism for Antenna Unit, and Positioning Mechanism Therefor)

Figure 36:
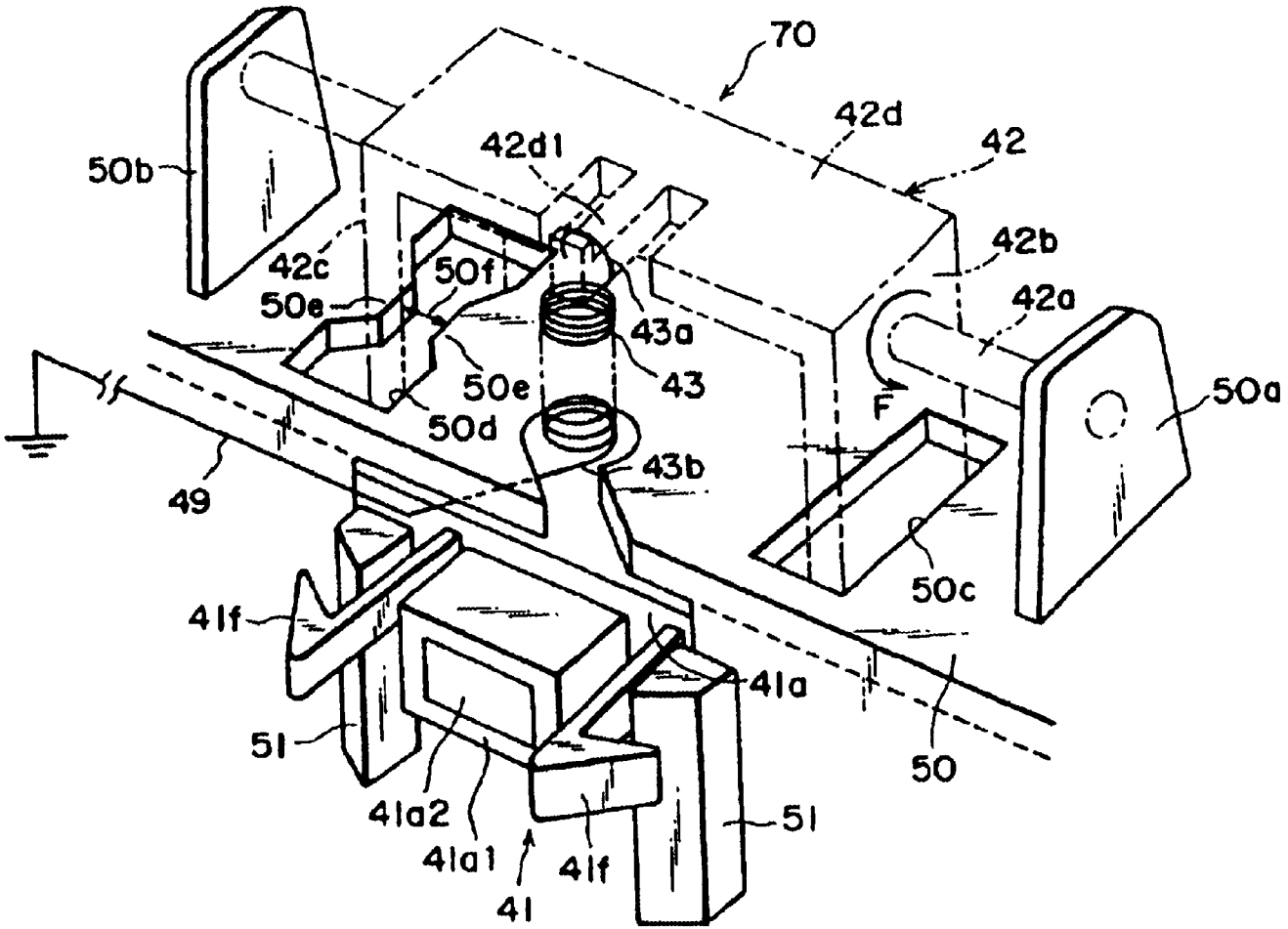
FIG. 36 shows details of a major part of an equalizer mechanism.
Figure 37:
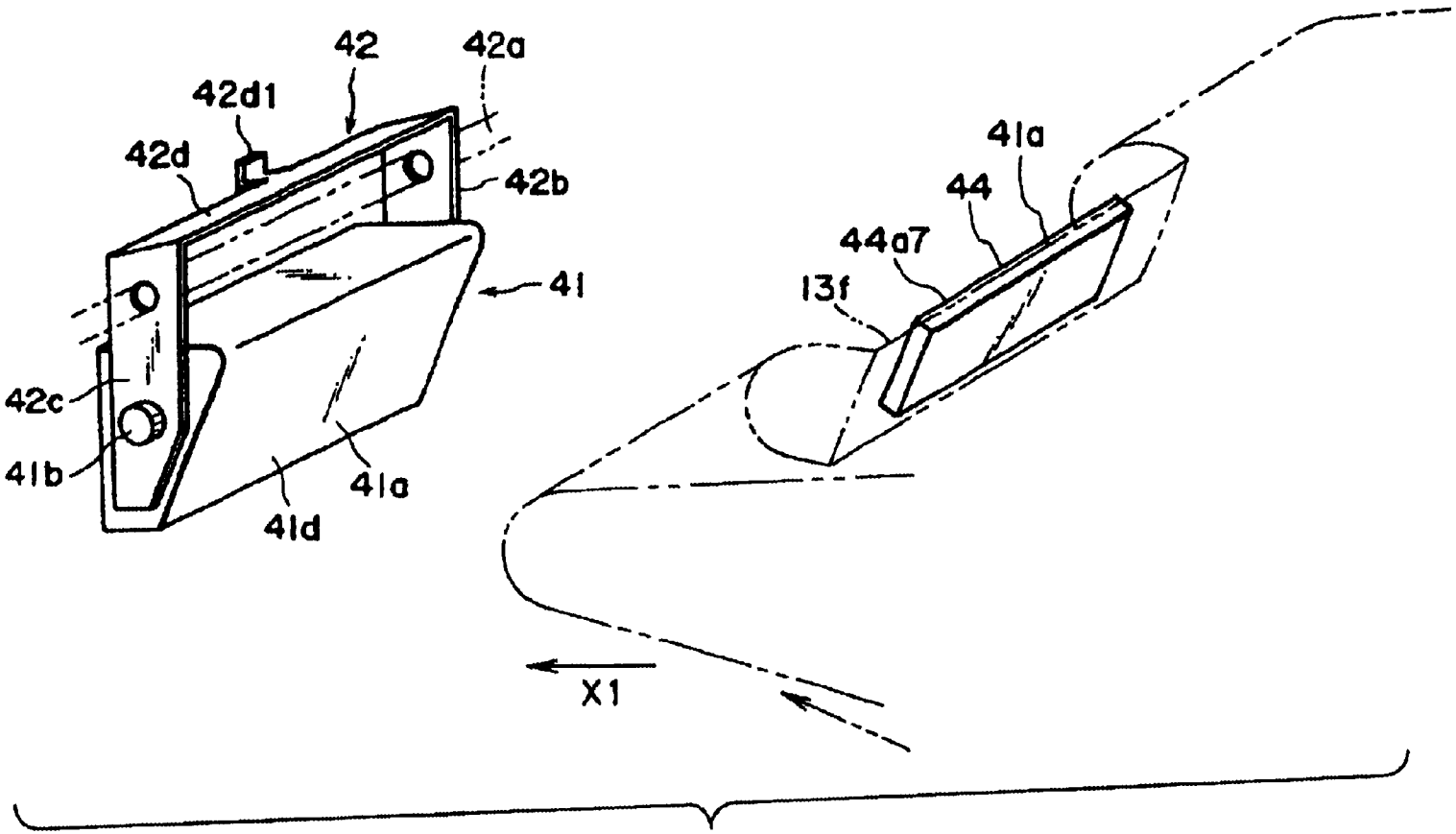
FIG. 37 is an exploded view of the antenna unit and the memory unit and a state of contact therebetween.

Referring to FIGS. 36 and 37, a description will be provided as to the urging mechanism and the positioning mechanism for the antenna unit.

In FIG. 36, designated by 50 is a main assembly frame provided in the main assembly 14 of the apparatus. The main assembly frame 50 has main assembly supporting members 50*a*, 50*b* which are opposed to each other in the longitudinal direction of the cartridge B. On the supporting members 50*a*, 50*b*, the supporting shaft 42*a* of the supporting member 42 is the supported rotatably. The supporting member 42 comprises supporting portions 42*b*, 42*c* for supporting the unit 41 and a connecting portion 42*d* of connecting the supporting portions 42*b*, 42*c*. It is substantially in the form of a channel. The supporting portions 42*b*, 42*c* penetrate holes 50*c*, 50*d* formed in the main assembly frame 50.

The supporting member 42 is positioned so as to be immovable in the longitudinal direction of the cartridge B by one of the supporting portions 42*c* being placed in the gap 50*f* formed between the projections 50*e* which are provided substantially at a center of the hole 50*d*. The connecting portion 42*d* of the supporting member 42 is provided with a locking segment 42*d*1 with which a hook 43*a* of a spring 43 is engaged. The other end 43*b* of the spring 43 is sunk into the lower surface of the main assembly frame 50 so that it is fixed to the main assembly frame 50. The other end 43*b* of the spring 43 is connected with a grounding portion of the main assembly 14 of the apparatus using an electroconductive lead 49. In this manner, by connecting the ends of the spring 43 with the supporting member 42 and the main assembly frame 50, an elastic force tension for urging the supporting member 42 toward the insertion path 55 of the cartridge B is provided. Here, the spring 43 is made of electroconductive material and is electrically grounded through an electroconductive lead 49.

Therefore, it functions as a conductor rod against static electricity.

As shown in FIG. 37, the supporting portions 42*b*, 42*c* of the supporting member 42 rotatably support the antenna unit 41 by the supporting shaft 41*b*. The unit 41 is supported by the supporting member 42 urged by the spring 43, so that it is in the insertion path 55 of the cartridge B when there is no cartridge B. The unit 41 is provided with a pair of hooks 41*f* at a side of the cartridge B opposite from the insertion path 55. These hooks 41*f* are provided on the antenna cover 41*a*. These hooks 41*f* are engaged with projections 51 of the main assembly frame 50, when the antenna unit 41 is in the insertion path 55 of the cartridge B by the supporting member 42. Thus, the hooks 41*f* function as a stopper against rotational motion of the supporting member 42 (the direction indicated by an arrow F in FIG. 7). The antenna cover 41*a* is substantially in the form of a box, and covers the antenna substrate 41*c* to protect it. The signal line 45*a* connecting the controlling unit 45 and the antenna substrate 41*c* of the unit 41 electrically connects them through a window 41*a*2 forming the cylindrical portion 41*a*1 constituting a part of the antenna cover 41*a*.

With the communicating unit 47 having the equalizer mechanism 70 having the above-described structure, the antenna unit 41 is in the insertion path 55 of the cartridge B when the cartridge B is not mounted to the main assembly 14 of the apparatus. When the cartridge B is inserted into the main assembly 14 of the apparatus, the unit 41 is brought into abutment with the unit 44. At this time, the unit 41 is rotatably supported, and the supporting member 42 is rotatably supported by the supporting shaft 42*a*. Therefore, with the further insertion of the cartridge B, it is retracted from the insertion path 55. With the cartridge B completely inserted into the main assembly 14 of the apparatus, the unit 41 is rotated, the supporting shaft 42*b* following the unit 41. By this, the antenna unit 41 is abutted to the surface of the memory unit 44 such that surfaces of them are parallel to each other. In this manner, the facing positions of the antenna unit 41 and the memory unit 44 are determined.

(Another Example 1 of Urging Mechanism and Positioning Mechanism for the Antenna Unit)

Figure 38:
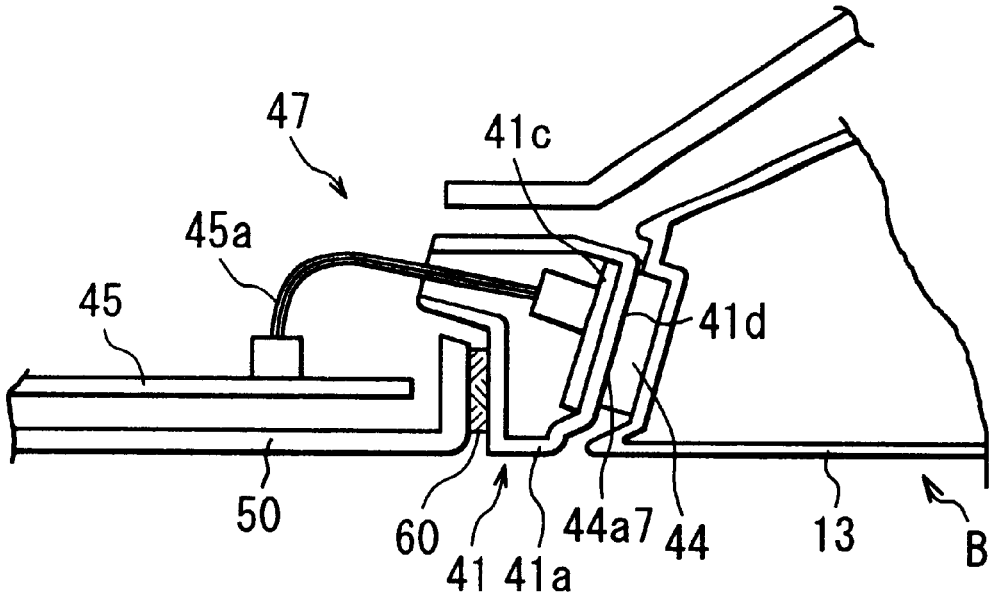
FIG. 38 is an illustration of another example of an urging mechanism and a positioning mechanism of the antenna unit.

FIG. 38 shows an urging mechanism and a positioning mechanism for the antenna unit according to another example of the present invention. FIG. 38 is an enlarged view of the contact portions between the memory unit 44 and the antenna unit 41.

In this embodiment, an elastic member 60 is provided between the main assembly frame 50 and the antenna unit 41, in place of the equalizer mechanism 70. One side of the elastic member 60 is bonded to the main assembly frame 50, and the opposite side is bonded to the antenna cover 41*a*. When the cartridge B is removed from the main assembly 14 of the apparatus, the elastic member 60 becomes free. By this, the antenna unit 41 is kept in an inserted state in the insertion path of the cartridge B by the elastic member 60, when the cartridge B is not mounted to the main assembly 14 of the apparatus. When the cartridge B is inserted into the main assembly 14 of the apparatus, the unit 41 is abutted to the unit 44 so that elastic member 60 is compressed, by which the unit 41 and unit 44 are kept contacted to and parallel with each other. That is, with the cartridge B completely inserted into the main assembly 14 of the apparatus, the antenna unit 41 is correctly faced to the memory unit 44.

(Another Example 2 of Urging Mechanism and Positioning Mechanism for the Antenna Unit)

Figure 39:
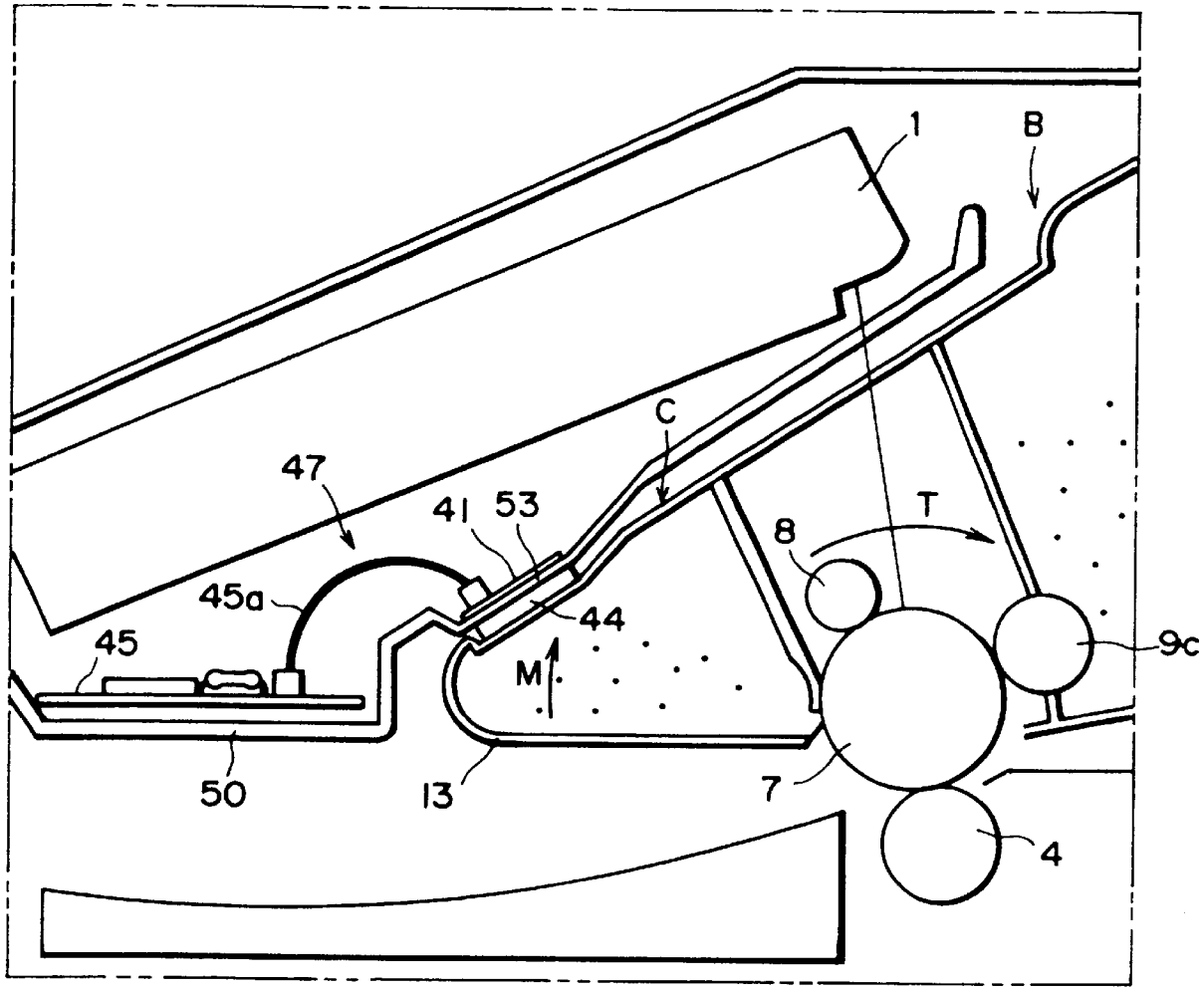
FIG. 39 is an illustration of a further example of the antenna unit urging mechanism and positioning mechanism.

FIG. 39 shows an urging mechanism and a positioning mechanism for the antenna unit according to a further example. FIG. 39 is an enlarged view of the contact portions between the memory unit 44 and the antenna unit 41.

According to this embodiment, the antenna unit 41 and the memory unit 44 can be abutted to each other without imparting an additional force against the positioning motion of the cartridge B.

As described in the foregoing, the positioning of the cartridge B relative to the main assembly 14 of the apparatus, is accomplished by the regulating abutment 13*j* and the cylindrical guides 13*a*R, 13*a*L. Namely, the cartridge B is supported by the cylindrical guides 13*a*R, 13*a*L provided coaxially with the photosensitive drum 7, by which the cartridge B is partly positioned relative to the main assembly 14 of the apparatus. The photosensitive drum 7 receives torque in the direction T from the main assembly 14 of the apparatus. By this, the neighborhood of the memory unit 44 provided on the upper surface of the cleaning unit C is urged in the direction M. Therefore, the position of the cartridge B is determined in the direction of the axis of the photosensitive drum 7 in the plane of this figure. In the rotational direction M of the cartridge B is positioned by abutment of the cleaning unit C to a rotation stopper 53 of the main assembly frame 50. In this example, the antenna unit 41 is disposed at the rotation stopper portion 53.

By doing so, the antenna unit 41 and the memory unit 44 are abutted to each other without additional force against the positioning of the cartridge B.

In this embodiment, the equalizer mechanism 70 is provided in the main assembly 14 of the apparatus, but an equalizer mechanism having the same function may be provided in the cartridge B. For example, in the case that antenna unit 41 is fixed to the main assembly 14 of the apparatus, the unit 44 may be mounted to the cleaning unit C with an equalizer mechanism therebetween such that the position of the memory unit 44 is determined to be aligned with the antenna unit 41. By this, when the cartridge B is completely inserted into the main assembly 14 of the apparatus, the unit 44 is correctly faced to the unit 41.

With the use of the wireless communicating mechanism described in the foregoing, the memory unit 44 is contacted by the antenna cover 41*a*, functioning as a protection layer having the necessary of minimum physical strength and durability against the electrostatic failure and by the frame member 44*a*. Therefore, the electric power required for the wireless communication can be minimized, so that assured wireless communication is accomplished with small power. This eliminates the necessity for a shield for preventing leakage of the radio waves. Thus, the power required by the wireless communication is minimized. In addition, since a small power is enough, the electric energy consumption is saved, and therefore, the electric circuit may be small and inexpensive.

In the case that a wireless communicating mechanism is used in an electrophotographic image forming apparatus A, the provision of the abutment portion for abutment between the memory unit 44 mounted to the cartridge B and a part (antenna unit 41 in this embodiment) of the communicating unit 47 provided in the main assembly 14 of the apparatus, is effective to assure the abutment between the communicating unit 47 and the memory unit 44 without disturbing the positioning of the cartridge B. Therefore, reading and writing of the necessary information can be accomplished with high precision. By supporting the antenna unit 41 with a mechanism permitting swing equalization, the abutment relative to the memory unit 44 is assured with minimum contact pressure. Therefore, the communication is assured without disturbance to the positioning of the cartridge B.

The communicating unit 47 is separated into two bodies, namely, the antenna unit 41 and the controlling unit 45. Therefore, the antenna unit 41 can be closely contacted to the memory unit 44 with a weak force. Thus, the relative positioning between the memory unit 44 and the antenna unit 41 is accomplished without causing a deterioration in the positioning accuracy and the mounting-and-demounting operability of the cartridge B. Since the relative position accuracy between the memory unit 44 and the antenna unit 41 is assured to be high, the power (intensity of the electromagnetic field) can be minimized. By doing so, the wireless communication is accomplished with such a small power as does not require a magnetic shield. When the antenna unit 41 is exposed at a position contacted to the detachably mountable cartridge B, a static stopper is desired, but because of the two-body structure, what is required is only to cover the antenna unit 41. Therefore, the required cost is low.

The antenna unit 41 is capsuled in an electrostatically safe box form.

Therefore, the latitude of arrangements in the main assembly 14 of the apparatus is enhanced, and the antenna unit may be disposed at an exposed position subjected to contact by the user. Therefore, the memory unit 44 and the antenna unit 41 can be contacted to each other. Because the contact of the antenna unit 41 is accomplished, the power required for the communication is minimized such that a magnetic shield or the like is unnecessary. When a shield is required, the usage of the wireless communicating mechanism is very much limited. The lack of necessity of the shield permits cost reduction. In addition, the wireless communicating mechanism can be used in the limited space in the main assembly 14 of the apparatus. In addition, since the required power is small, the electric energy consumption can be decreased and the electric circuit can be minimized, since contact is without requiring insertion as with the case of a connector, and the mounting-and-demounting operability of the cartridge B does not deteriorate.

In the embodiment, the antenna unit 41 is in the form of a box type capsule which is electrostatically safe, but the entirety of the communicating unit 47 may be in the form of a box type capsule which is electrostatically safe.

The spring 43 disposed adjacent the antenna unit 41 is of electroconductive material, and has an end 43*b* which is electrically grounded through the electroconductive line 49. Therefore, the spring 43 functions as a conductor rod. Therefore, even if the withstand voltage of the antenna cover 41*a* for protecting the antenna unit 41 is low, the electric discharge from the body of the user would not directly attack the unit 41. Therefore, the durability against electrostatic failure is high. Therefore, the antenna unit 41 can be provided at such a position that when the detachably mountable cartridge B is dismounted from the main assembly 14 of the apparatus, the antenna unit 41 may be touched by a user's hand. This means that it can be disposed closest to the cartridge B. Because of the permissible low withstand voltage of the antenna cover 41*a*, the antenna cover 41*a* may be thin, or it may be constructed using a joint and/or a fitting. Therefore, the ease of assembly of the antenna unit 41 is improved with the result of a cost saving. The antenna unit 41 is abutted to the cartridge B by the electrically grounded spring 43. Therefore, no additional force is imparted to the antenna unit 41, and therefore, the cartridge B can be inserted smoothly. Additionally, the necessity for an urging spring adjacent the antenna unit 41 can be eliminated. Therefore, the electrical interference due to the urging spring can be avoided.

The embodiments described in the foregoing are summarized as follows.

An electrophotographic image formation system forms an image on a recording material, the improvement residing in that when a process cartridge (B) is mounted, to form an image on a recording material, to a main assembly (14)

of an electrophotographic image forming apparatus including a main assembly (14) antenna cover (41*a*) with a main assembly (14) antenna outer casing member, the process cartridge (B) including an electrophotographic photosensitive member (7), process means (charging means 8, developing means 9, cleaning means 10) actable on the electrophotographic photosensitive member (7), a storing element (44*b*1) storing information, a memory antenna (communication antenna 44*b*2) for communication with the main assembly (14) antenna, and a memory antenna (communication antenna 44*b*2) outer casing member (frame member 44*a*) for covering the storing element (44*b*1) and the memory antenna (communication antenna 44*b*2), positioning is effected for a gap between the memory antenna (communication antenna 44*b*2) and the main assembly (14) antenna by contact between an outer surface of the outer casing member (frame member 44*a*) and an outer surface of an outer casing member (frame member 44*a*) of the main assembly (14) antenna.

A process cartridge (B) is detachably mountable to a main assembly (14) of an electrophotographic image forming apparatus which has a main assembly (14) antenna cover (41*a*) with a main assembly (14) antenna outer casing member, and the process cartridge (B) comprises:

an electrophotographic photosensitive member (7);

process means (charging means 8, developing means 9, cleaning means 10) actable on the electrophotographic photosensitive member (7);

storing means for storing information;

a memory antenna (communication antenna 44*b*2) for communication with the main assembly (14) antenna;

a memory antenna (communication antenna 44*b*2) outer casing member (frame member 44*a*) covering the storing element (44*b*1) and the memory antenna (communication antenna 44*b*2);

wherein when the process cartridge (B) is mounted to the main assembly (14) of the apparatus, positioning is effected for a gap between the memory antenna (communication antenna 44*b*2) and the main assembly (14) antenna by contact between an outer surface of the outer casing member (frame member 44*a*) and the outer surface of an outer casing member (frame member 44*a*) of the main assembly (14) antenna.

An electrophotographic image forming apparatus forms an image on a recording material, to which a process cartridge (B) is detachably mountable, the electrophotographic image forming apparatus comprising:

(a) a main assembly (14) antenna cover (41*a*) with a main assembly (14) antenna outer casing member;

(b) a mounting portion (13*k*) for demountably mounting a process cartridge (B) which comprises an electrophotographic photosensitive member (7), process means (charging means 8, developing means 9, cleaning means 10) actable on the electrophotographic photosensitive member (7), a storing element (44*b*1) for storing information, a memory antenna (communication antenna 44*b*2) for communication with the main assembly (14) antenna, a memory antenna (communication antenna 44*b*2) outer casing member (frame member 44*a*) (44*a*) covering the memory antenna (communication antenna 44*b*2);

the apparatus further comprising:

(c) feeding means for feeding the recording material, wherein when the process cartridge (B) is mounted to the main assembly (14) of the apparatus, positioning is effected for a gap between the memory antenna (communication antenna 44*b*2) and the main assembly (14) antenna by contact between an outer surface of the outer casing member (frame member 44*a*) and an outer surface of an outer casing member (frame member 44*a*) of the main assembly (14) antenna.

It may be that the main assembly (14) antenna is spaced from an inner surface of the main assembly (14) antenna outer casing member.

It may be that the main assembly (14) antenna is contacted to an inner surface of the main assembly (14) antenna outer casing member. (FIG. 39)

It may be that the memory antenna (communication antenna 44*b*2) is spaced from an inner surface of the memory antenna (communication antenna 44*b*2) outer casing member (frame member 44*a*). (FIGS. 16 and 18, for example)

It may be that the memory antenna (communication antenna 44*b*2) is contacted to an inner surface of the memory antenna (communication antenna 44*b*2) outer casing member (frame member 44*a*) (44*a*).

It may be that the storing element (44*b*1) and the memory antenna (communication antenna 44*b*2) are provided in a base (base plate 44*b*3), and wherein the base (base plate 44*b*3) is provided with a sending member (communication circuit 44*b*11) for sending of the information stored in the storing element (44*b*1) to the memory antenna (communication antenna 44*b*2), wherein the memory antenna (communication antenna 44*b*2) outer casing member (frame member 44*a*) (44*a*) also covers the sending member (communication circuit 44*b*11).

It may be that the memory antenna (communication antenna 44*b*2) outer casing member (frame member 44*a*) (44*a*) is contacted to an outer surface of the main assembly (14) antenna outer casing member (frame member 44*a*) at a position of the memory antenna (communication antenna 44*b*2) outer casing member (frame member 44*a*) (44*a*) which is at a leading side with respect to a mounting direction of the memory antenna (communication antenna 44*b*2) to the main assembly (14) of the electrophotographic image forming apparatus.

It may be that the process means (charging means 8, developing means 9, cleaning means 10) includes at least one of charging means for charging the electrophotographic photosensitive member (7), developing means for developing an electrostatic latent image formed on the electrophotographic photosensitive member (7) and cleaning means for removal of a developer remaining on the electrophotographic photosensitive member (7).

(Other Embodiments)

In the foregoing, a description has been provided with respect to embodiments in which the wireless communicating mechanism comprising the communicating unit and the memory unit is used in a cartridge, but this usage is not limiting. It is applicable to a feeding cassette for accommodating recording materials in the main body unit frame of the cassette, if the feeding cassette is demountable from the main assembly of the apparatus. It is also applicable to a fixing unit comprising a unit frame, a pressing roller and a fixing roller which are supported by the unit frame to fix toner images on recording materials if the fixing unit is demountable from the main assembly of the apparatus,. It is also preferably applicable to a developing unit comprising a unit frame, a developer container and developing means which are supported by the unit frame to develop electrostatic latent images formed on the electrophotographic photosensitive member with a developer, if the developing unit is detachably mountable to the main assembly of the apparatus. Therefore, the unit to which the present invention is applicable includes a feeding cassette, a fixing unit and a developing unit.

The process cartridge B to which the present invention is applicable is not limited to a process cartridge for formation of the monochromatic image is, but may be a color cartridge for formation of a multicolor image (two-color images, three-color images, full-color images or the like) using a plurality of developing means.

In the above-described, the electrophotographic photosensitive member has been described as a photosensitive drum, and the electrophotographic photosensitive member is not limited to such a photosensitive drum, and the following is usable. The photosensitive member may be a photoconductor which may be an amorphous silicon, amorphous selenium, zinc oxide, titanium oxide, organic photoconductor (OPC) or the like. The photosensitive member may be in the form of a drum, a belt or another rotatable member, or a sheet, or the like. Generally, however, a drum or a belt is used, and in the case of a drum type photosensitive member, a cylinder of aluminum alloy or the like is coated with a photoconductor by evaporation or application or the like.

Also, the present invention is preferably usable with various known developing methods such as the magnetic brush developing method using two component toner, the cascade developing method, the touch-down developing method, the cloud developing method.

The structure of the charging means described in the foregoing is of a so-called contact type charging method, but a known charging means comprising a tungsten wire which is enclosed width metal shield of aluminum or the like at three sides, wherein positive or negative ions generated by application of a high voltage to the tungsten wire are directed to the surface of the photosensitive drum to uniformly charged the surface, is usable.

The charging means may be a roller type as described in the foregoing, a blade type (charging blade), a pad type, a block type, a rod type, a wire type or the like.

As for a cleaning method for removing toner remaining on the photosensitive drum, a blade, a fur brush, a magnetic brush or the like is usable.

The process cartridge, for example, comprises an electrophotographic photosensitive member and at least one process means. As for the types of the process cartridge, there are, in addition to those disclosed hereinbefore, a type in which, for example, an electrophotographic photosensitive member and charging means are unified integrally into a cartridge which is detachably mountable to the main assembly of the electrophotographic image forming apparatus, a type in which an electrophotographic photosensitive member and developing means are unified integrally into a cartridge which is detachably mountable to a main assembly of the apparatus, a type in which an electrophotographic photosensitive member and cleaning means are unified integrally into a cartridge which is detachably mountable to a main assembly of an electrophotographic image forming apparatus, and a type in which an electrophotographic photosensitive member and two or more of the process means are combined integrally into a cartridge which is detachably mountable to a main assembly of an electrophotographic image forming apparatus.

The process cartridge may integrally contain an electrophotographic photosensitive drum, and charging means, developing means or cleaning means, in the form of a unit or a cartridge, which is detachably mountable to a main assembly of an image forming apparatus. The process cartridge may integrally contain an electrophotographic photosensitive drum, and at least one of charging means, developing means and cleaning means, in the form of a unit or a cartridge, which is detachably mountable to a main assembly of an image forming apparatus. Furthermore, the process cartridge may contain at least the electrophotographic photosensitive drum and the developing means, in the form of a unit or a cartridge, which is detachably mountable to a main assembly of an image forming apparatus. The process cartridge is mounted to or demounted from the main assembly of the apparatus by the user. This means that maintenance of the apparatus is carried out, in effect, by the user.

In the foregoing embodiments, a laser beam printer has been taken as an example of the electrophotographic image forming apparatus, but the present invention is not limited thereto, and the present invention is applicable to an electrophotographic copying machine, a facsimile machine, a facsimile machine or the like of an electrophotographic type.

As described in the foregoing, according to the present invention, the gap between the memory antenna and the main assembly antenna can be maintained accurately.

Additionally, according to the present invention, a process cartridge capable of wireless communication is provided.

Moreover, according to the present invention, there is provided an electrophotographic image forming apparatus to which a process cartridge is mountable that is capable of wireless communication.

Furthermore, according to the present invention, there is provided an electrophotographic image formation system in which a process cartridge capable of wireless communication is detachably mountable.

While the invention has been described with reference to the structures disclosed herein, it is not confined to the details set forth and this application is intended to cover such modifications or changes as may come within the purpose of the improvements or the scope of the following claims.

What is claimed is:

1. An electrophotographic image formation system for forming an image on a recording material, said system comprising:

an electrophotographic image forming apparatus; and a process cartridge detachably mountable on said electrophotographic image forming apparatus, wherein said electrophotographic image forming apparatus comprises:

a main assembly;

a main assembly antenna; and a main assembly antenna outer casing member configured and positioned to cover said main assembly antenna, wherein said main assembly antenna outer casing member is rotatably supported on said main assembly of said apparatus, wherein said process cartridge comprises:

an electrophotographic photosensitive member;

process means actable on said electrophotographic photosensitive member;

a storing element configured to store information;

a memory antenna configured and positioned to communicate with said main assembly antenna; and a memory antenna outer casing member configured and positioned to cover said storing element and said memory antenna, wherein when said process cartridge is not mounted to said main assembly of said apparatus, said main assembly antenna outer casing member is in an insertion passage of said process cartridge, and when said process cartridge is mounted to said main assembly of said apparatus through said insertion passage, said main assembly antenna outer casing member rotatably supported on said main assembly of said apparatus is retracted from said insertion passage by being pressed by said process cartridge, and when said process cartridge is mounted to a predetermined position in said main assembly of said apparatus, positioning is effected for a gap between said memory antenna and said main assembly antenna by contact between an outer surface of said memory antenna outer casing member and an outer surface of said main assembly antenna outer casing member of said main assembly antenna.

2. A system according to claim 1, wherein said main assembly antenna is spaced from an inner surface of said main assembly antenna outer casing member.

3. A system according to claim 1, wherein said main assembly antenna is contacted to an inner surface of said main assembly antenna outer casing member.

4. A system according to claim 1, 2 or 3, wherein said memory antenna is spaced from an inner surface of said memory antenna outer casing member.

5. A system according to claim 1, 2 or 3, wherein said memory antenna is contacted to an inner surface of said memory antenna outer casing member.

6. A system according to any one of claims 1–3, wherein said storing element and said memory antenna are provided in a base, and wherein said base is provided with a sending member for sending of the information stored in said storing element to said memory antenna, wherein said memory antenna outer casing member also covers said sending member.

7. A system according to any one of claims 1–3, wherein said memory antenna outer casing member is contacted to an outer surface of said main assembly antenna outer casing member at a position of said memory antenna outer casing member which is at a leading side with respect to a mounting direction of said process cartridge to said main assembly of said electrophotographic image forming apparatus.

8. A system according to any one of claims 1–3, wherein said process means includes at least one of charging means for charging said electrophotographic photosensitive member, developing means for developing an electrostatic latent image formed on said electrophotographic photosensitive member and cleaning means for removal of a developer remaining on said electrophotographic photosensitive member.

9. A system according to claim 1, further comprising a supporting member which is rotatable about a shaft provided on said main assembly of said apparatus, wherein said main assembly antenna outer casing member is rotatably supported on said supporting member.

10. A process cartridge detachably mountable to a main assembly of an electrophotographic image forming apparatus which has a main assembly antenna covered with a main assembly antenna outer casing member, wherein the main assembly antenna outer casing member is rotatably supported on the main assembly of the apparatus, said process cartridge comprising:

an electrophotographic photosensitive member;

process means actable on said electrophotographic photosensitive member;

a storing element configured to store information;

a memory antenna configured and positioned to communicate with the main assembly antenna; and a memory antenna outer casing member configured and positioned to cover said storing element and said memory antenna, wherein when said process cartridge is not mounted to the main assembly of the apparatus, the main assembly antenna outer casing member is in an insertion passage of said process cartridge, and when said process cartridge is mounted to the main assembly of the apparatus through said insertion passage, the main assembly antenna outer casing member rotatably supported on the main assembly of the apparatus is retracted from the insertion passage by being pressed by said process cartridge, and when said process cartridge is mounted to a predetermined position in the main assembly of the apparatus, positioning is effected for a gap between said memory antenna and the main assembly antenna by contact between an outer surface of said memory antenna outer casing member and an outer surface of the main assembly antenna outer casing member of the main assembly antenna.

11. A process cartridge according to claim 10, wherein the main assembly antenna is spaced from an inner surface of the main assembly antenna outer casing member.

12. A process cartridge according to claim 10, wherein the main assembly antenna is contacted to an inner surface of the main assembly antenna outer casing member.

13. A process cartridge according to claim 10, 11 or 12, wherein said memory antenna is spaced from an inner surface of said memory antenna outer casing member.

14. A process cartridge according to claim 10, 11 or 12, wherein said memory antenna is contacted to an inner surface of said memory antenna outer casing member.

15. A process cartridge according to any one of claims 10–12, wherein said storing element and said memory antenna are provided in a base, and wherein said base is provided with a sending member for sending of the information stored in said storing element to said memory antenna, wherein said memory antenna outer casing member also covers said sending member.

16. A process cartridge according to any one of claims 10–12, wherein said memory antenna outer casing member is contacted to an outer surface of the main assembly antenna outer casing member at a position of said memory antenna outer casing member which is at a leading side with respect to a mounting direction of said process cartridge to the main assembly of the electrophotographic image forming apparatus.

17. A process cartridge according to any one of claims 10–12, wherein said process means includes at least one of charging means for charging said electrophotographic photosensitive member, developing means for developing an electrostatic latent image formed on said electrophotographic photosensitive member and cleaning means for removal of a developer remaining on said electrophotographic photosensitive member.

18. A process cartridge according to claim 10, further comprising a supporting member which is rotatable about a shaft provided on the main assembly of the apparatus, wherein the main assembly antenna outer casing member is rotatably supported on said supporting member.

19. An electrophotographic image forming apparatus for forming an image on a recording material, to which a process cartridge is detachably mountable, said electrophotographic image forming apparatus comprising:

(a) a main assembly antenna covered with a main assembly antenna outer casing member, wherein said main assembly antenna outer casing member is rotatably supported on a main assembly of said apparatus;

(b) a mounting portion configured and positioned to detachably mount the process cartridge which comprises an electrophotographic photosensitive member, process means actable on the electrophotographic photosensitive member, a storing element configured to store information, a memory antenna configured and positioned to communicate with said main assembly antenna, and a memory antenna outer casing member configured and positioned to cover the storing element and the memory antenna; and (c) feeding means for feeding the recording material, wherein when the process cartridge is not mounted to the main assembly of said apparatus, said main assembly antenna outer casing member is in an insertion passage of the process cartridge, and when the process cartridge is mounted to the main assembly of said apparatus through the insertion passage, said main assembly antenna outer casing member rotatably supported on the main assembly of said apparatus is retracted from the insertion passage by being pressed by the process cartridge, and when the process cartridge is mounted to a predetermined position in the main assembly of said apparatus, positioning is effected for a gap between the memory antenna and said main assembly antenna by contact between an outer surface of the memory antenna outer casing member and an outer surface of said main assembly antenna outer casing member of said main assembly antenna.

20. An apparatus according to claim 19, wherein said main assembly antenna is spaced from an inner surface of said main assembly antenna outer casing member.

21. An apparatus according to claim 19, wherein said main assembly antenna is contacted to an inner surface of said main assembly antenna outer casing member.

22. An apparatus according to claims 19, 20 or 21, wherein the memory antenna is spaced from an inner surface of the memory antenna outer casing member.

23. An apparatus according to claims 19, 20 or 21, wherein the memory antenna is contacted to an inner surface of the memory antenna outer casing member.

24. An apparatus according to claims 19, 20 or 21, wherein the storing element and the memory antenna are provided in a base, and wherein the base is provided with a sending member for sending of the information stored in the storing element to the memory antenna, wherein the memory antenna outer casing member also covers the sending member.

25. An apparatus according to any one of claims 19–21, wherein the memory antenna outer casing member is contacted to an outer surface of said main assembly antenna outer casing member at a position of the memory antenna outer casing member which is at a leading side with respect to a mounting direction of the process cartridge to the main assembly of said electrophotographic image forming apparatus.

26. An apparatus according to any one of claims 19–21, wherein the process means includes at least one of charging means for charging the electrophotographic photosensitive member, developing means for developing an electrostatic latent image formed on the electrophotographic photosensitive member and cleaning means for removal of a developer remaining on the electrophotographic photosensitive member.

27. An apparatus according to claim 19, further comprising a supporting member which is rotatable about a shaft provided on the main assembly of said apparatus, wherein said main assembly antenna outer casing member is rotatably supported on said supporting member.

* * * * *

UNITED STATES PATENT AND TRADEMARK OFFICE

CERTIFICATE OF CORRECTION

PATENT NO. : 6,782,222 B1
DATED : August 24, 2004
INVENTOR(S) : Yoshihiro Ito et al.

It is certified that error appears in the above-identified patent and that said Letters Patent is hereby corrected as shown below:

Title page,
Item [57], ABSTRACT,
Line 2, “material” should read -- material. --.

Column 7,
Line 8, “material 2” should read -- material 2. --.

Column 15,
Line 43, “be” should be deleted.

Column 17,
Line 62, “apparatus,.” should read -- apparatus. --.

Column 20,
Line 13, “mounted” should read -- is mounted --.

Column 22,
Line 38, “in the” should read -- the --.

Column 29,
Line 39, “charged” should read -- charge --.

Signed and Sealed this

Twenty-third Day of November, 2004

JON W. DUDAS
*Director of the United States Patent and Trademark Office*